US005855169A

United States Patent [19]

Mori et al.

[11] Patent Number: 5,855,169

[45] Date of Patent: Jan. 5, 1999

[54] DRUM AND STENCIL FOR A STENCIL PRINTING

[75] Inventors: Tomiya Mori, Kakuda; Kazuto Yaegashi, Iwanuma, both of Japan

[73] Assignee: Tohoku Ricoh Co., Ltd., Miyagi-ken, Japan

[21] Appl. No.: 982,418

[22] Filed: Dec. 2, 1997

Related U.S. Application Data

[62] Division of Ser. No. 598,432, Feb. 8, 1996, Pat. No. 5,740, 734.

[30] Foreign Application Priority Data

Feb. 10, 1995 [JP] Japan ..... 7-22916
Jun. 30, 1995 [JP] Japan ..... 7-166178

[51] Int. Cl.[6] ..... B41L 13/04

[52] U.S. Cl. ..... 101/116; 101/128.2

[58] Field of Search ..... 101/114, 116, 101/127, 128.21, 128.4, 129

[56] References Cited

U.S. PATENT DOCUMENTS

| | | | |
|---|---|---|---|
| 3,877,364 | 4/1975 | Guy . | |
| 4,088,073 | 5/1978 | Crystal et al. | 101/128.4 |
| 4,537,658 | 8/1985 | Hans . | |
| 4,541,895 | 9/1985 | Hans . | |
| 4,911,069 | 3/1990 | Hayama et al. . | |
| 5,089,341 | 2/1992 | Yoshimura et al. . | |
| 5,188,881 | 2/1993 | Sugiyama et al. . | |
| 5,662,040 | 9/1997 | Mori et al. | 101/128.21 |

FOREIGN PATENT DOCUMENTS

| | | | |
|---|---|---|---|
| 0 127192 | 12/1984 | European Pat. Off. . | |
| 0 453 579 | 10/1991 | European Pat. Off. . | |
| 0 613 056 | 8/1994 | European Pat. Off. . | |
| 0 639 468 | 2/1995 | European Pat. Off. . | |
| 0 688 681 | 12/1995 | European Pat. Off. . | |
| 34 44082 | 8/1986 | Germany . | |
| 59-218889 | 12/1984 | Japan . | |
| 61-169294 | 7/1986 | Japan | 101/128.21 |
| 63-59393 | 11/1988 | Japan . | |
| 1-204781 | 8/1989 | Japan . | |
| 1-267094 | 10/1989 | Japan . | |
| 2-122987 | 5/1990 | Japan . | |
| 5-41026 | 10/1993 | Japan . | |
| 995620 | 6/1965 | United Kingdom . | |
| 1046280 | 10/1966 | United Kingdom . | |
| 2 254 288 | 10/1992 | United Kingdom . | |

*Primary Examiner*—Ren Yan
*Attorney, Agent, or Firm*—Oblon, Spivak, McClelland, Maier & Neustadt, P.C.

[57] ABSTRACT

A drum, stencil and ink holding member for a stencil printer are disclosed. The stencil is made up of a porous substrate and a thermoplastic resin film. The side of the substrate contacting the film has a surface roughness of 5 μm Rz to 45 μm Rz, preferably 5 μm Rz to 35 μm Rz or more preferably 5 μm Rz to 25 μm Rz.

30 Claims, 16 Drawing Sheets

DRUM AND STENCIL FOR A STENCIL PRINTING

This is a divisional application of U.S. patent application Ser. No. 08/598,432, filed on Feb. 8, 1996, now U.S. Pat. No. 5,740,734.

BACKGROUND OF THE INVENTION

The present invention relates to a drum and a stencil for use in a stencil printer and, more particularly, to an ink holding member and a stencil for a stencil printer and capable of effectively obviating the transfer of ink from the front of an underlying paper to the rear of an overlying paper.

A digital stencil printer generally includes a thermal head for perforating a thermosensitive stencil in accordance with data representative of a document image. The perforated stencil or master is wrapped around a rotatable drum. The drum is made up of a hollow cylindrical porous support, and an ink holding layer implemented as, e.g., a mesh screen of resin fibers or metal fibers. Ink feeding means is disposed in the drum and feeds ink to the drum. A press roller or similar pressing member presses a paper against the master wrapped around the drum. As a result, the ink is transferred from the drum to the paper via the pores of the drum and the perforations of the master, thereby printing the document image on the paper. The stencil is made up of a thermoplastic resin film (as thin as about 1 $\mu$m to 2 $\mu$m) and a porous substrate adhered to each other. The porous substrate is implemented by Japanese paper fibers or synthetic fibers or a mixture thereof.

It is a common practice with the above printer to use oil ink or water-in-oil type emulsion ink which is sparingly volatile. This kind of ink obviates defective printings ascribable to evaporation which occurs when the printer is operated after a long interval or after a printing operation. However, such an ink does not dry easily. This brings about a problem that a substantial period of time is necessary for the ink transferred to the paper to infiltrate into the paper and dry to such a degree that it does not run when, e.g., rubbed by finger.

In the stencil printer, papers carrying images thereon, i.e., printings are sequentially stacked on a tray. When the following paper is immediately stacked on the preceding paper existing on the tray, the ink is transferred from the front of the preceding paper to the rear of the following paper due to the short drying time. As a result, the rear of the following paper is smeared by the ink. This kind of smearing, i.e., rear smearing as referred to hereinafter often occurs when the ink transferred to the paper and forming an image is great in amount, particularly when the ink layer on the paper is thick, i.e., high.

Moreover, in the conventional stencil printer, the porous support and ink holding layer of the drum each has pores (bores) greater in size than perforations to be formed in the stencil by the head. Therefore, it is almost impossible to reduce the amount of ink transfer to the paper in order to obviate rear smearing.

In addition, the conventional porous substrate and mesh screen includes many portions which cause the incoming ink to simply flow out without being deflected. In such portions, the ink is transferred to the paper in a great amount and brings about rear smearing.

Japanese Patent Laid-Open Publication Nos. 1-204781 (corresponding to U.S. Pat. No. 4,911,069), 59-218889, and 1-267094, Japanese Patent Publication No. 63-59393, and Japanese Utility Model Publication No. 5-41026 are the prior art appearing to be relevant to the present invention.

SUMMARY OF THE INVENTION

It is an object of the present invention to provide a drum and a stencil for use in a stencil printer and capable of effectively obviating rear smearing.

In accordance with the present invention, in a stencil for a stencil printer and comprising a thermoplastic resin film and a porous substrate adhered to each other, the porous substrate has a surface roughness of 5 $\mu$m Rz to 45 $\mu$m Rz on the side thereof contacting the thermoplastic resin film.

In accordance with the present invention, in a drum for a stencil printer and comprising an ink holding member on the outer periphery thereof for wrapping a stencil which comprises only a thermoplastic resin film, the ink holding member has a surface roughness of 5 $\mu$m Rz to 45 $\mu$m Rz on the outer surface thereof.

In accordance with the present invention, in a drum for a stencil printer and comprising an ink holding member on the outer periphery thereof for wrapping a stencil which comprises a thermoplastic resin film and a porous substrate adhered to each other, the sum of the surface roughness of the ink holding member, as measured on the side thereof contacting the porous substrate, and the thickness of the porous substrate is greater than 5 $\mu$m inclusive, but smaller than 45 $\mu$m inclusive.

In accordance with the present invention, in a stencil printer, an ink holding member constituting the outer periphery of a drum has a surface roughness of 5 $\mu$m Rz to 45 $\mu$m Rz.

In accordance with the present invention, in a stencil for a stencil printer and comprising a thermoplastic resin film and a porous substrate constituted by fibers and adhered to the thermoplastic resin film, the porous substrate has a fiber diameter of greater than 1 $\mu$m inclusive, but smaller than 20 $\mu$m inclusive, as measured on the surface thereof contacting the thermoplastic resin film.

In accordance with the present invention, in a drum for a stencil printer and comprising an ink holding member constituted by fibers on the outer periphery thereof for wrapping a stencil which comprises only a thermoplastic resin film, the ink holding member has a fiber diameter of greater than 1 $\mu$m inclusive, but smaller than 20 $\mu$m inclusive.

In accordance with the present invention, in a drum for a stencil printer and comprising a plurality of ink holding members laminated in layers and constituted by fibers on the outer periphery thereof for wrapping a stencil which comprises only a thermoplastic resin film, the plurality of ink holding members have bores thereinside which sequentially decrease in size from the innermost one of the layers to the outermost one of the layers, and the outermost one of the layers has a fiber diameter of greater than 1 $\mu$m inclusive, but smaller than 20 $\mu$m inclusive, as measured on the outer surface thereof.

In accordance with the present invention, in a drum for a stencil printer and comprising a single ink holding member in the form of a layer and constituted by fibers on the outer periphery thereof for wrapping a stencil which comprises only a thermoplastic resin film, the ink holding member has bores thereinside which sequentially decrease in size toward the outer surface of the ink holding member, and the ink holding member has a fiber diameter of greater than 1 $\mu$m inclusive, but smaller than 20 $\mu$m inclusive, as measured on the outer surface thereof.

In accordance with the present invention, in a stencil printer, an ink holding member forming the outer periphery of a drum comprises fibers and has a fiber diameter of greater than 1 $\mu$m inclusive, but smaller than 20 $\mu$m, as measured the outer surface thereof.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Referring to FIG. I of the drawings, a stencil printer using a first embodiment of the present invention is shown in a fragmentary view. As shown, the printer has a drum 1 which is rotated by drum driving means, not shown. An ink pipe 2, an ink roller 3 and a doctor roller 4 are disposed in the drum 1.

Figure 2:
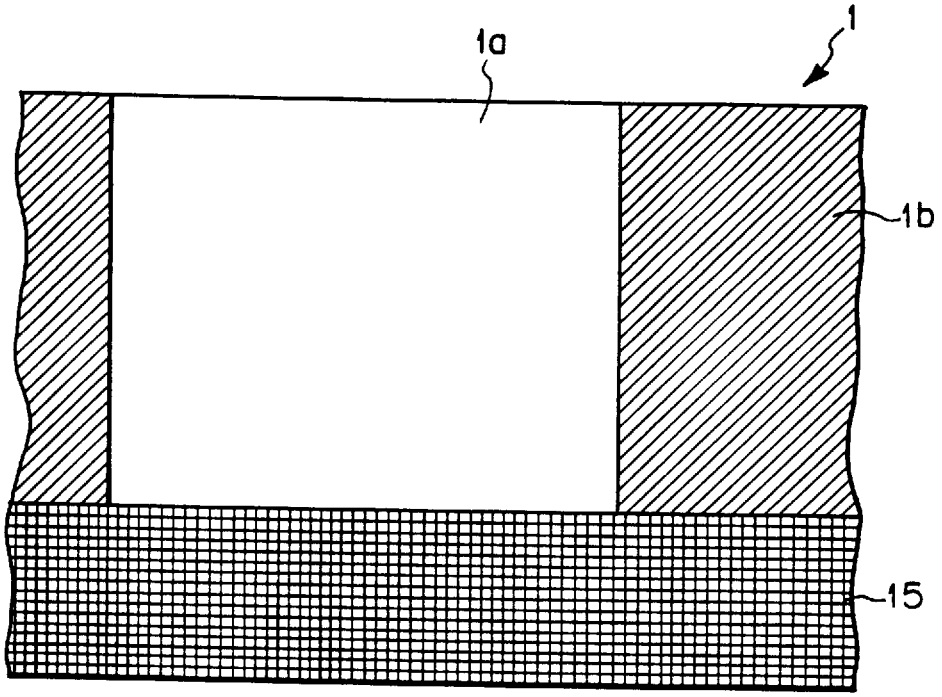
FIG. 2 is a fragmentary sectional side elevation of a drum and an ink holding member with which the first embodiment to a sixth embodiment are practicable.

As shown in FIG. 2, the drum 1 is made up of a hollow cylindrical porous support 1*b* formed with pores 1*a* (only one is shown), and an ink holding layer 15 covering the outer periphery of the support 1*b*. The layer 15 is implemented by a mesh screen consisting of, e.g., intersecting fibers of Tetron (trade name), nylon (trade name) or similar synthetic resin or intersecting fibers of stainless steel. The layer 15 has passageways for passing ink and spreads, holds, and forces out the ink. If desired, a plurality of such layers 15 may be combined in a laminate structure. Further, layer 15 may even be omitted.

The ink pipe 2 is affixed to the side walls of a housing, not shown, and plays the role of a support shaft for the drum 1 at the same time. A plurality of apertures are formed in the pipe 2 in order to feed the ink into the drum 1. Specifically, the ink is fed under pressure to the pipe 2 by a pump, not shown, from an ink pack located at the outside of the drum 1. The ink roller 3 and doctor roller 4 are disposed below the pipe 2. The ink roller 3 is rotatably supported by side walls, not shown, positioned in the drum 1. The outer periphery of the roller 3 is so positioned as to adjoin the inner periphery of the drum 1. The ink is fed from the pipe 2 to the drum 1 by way of the roller 3. The torque of drum driving means is transmitted to the roller 3 by gears, belt or similar drive transmitting means, not shown, so that the roller 3 is rotated clockwise, as viewed in FIG. 1, in synchronism with the drum 1.

The doctor roller 4 which is free to rotate is positioned in the vicinity of the ink roller 3 and spaced from the roller 3 by a small gap. As a result, a wedge-like ink well 5 is formed between the outer periphery of the roller 3 and that of the roller 4. The ink fed from the pipe 2 to the well 5 is passed through the gap between the rollers 3 and 4 and deposited on the roller 3 in a uniform distribution.

A stage 6 is provided on the portion of the drum 1 where the pores 1*a* are absent. The stage 6 extends in the axial direction of the drum 1 and is made of a magnetic material. A damper 7 is mounted on the stage 6 and pivotable toward and away from the stage 6. The damper 7 has a magnet and is pivotally moved by opening and closing means, not shown.

A stencil roll 9, a thermal head 10, a platen roller 11, a conveyor roller pair 12, cutting means 13 and a stencil guide 14 are located above and at the left-hand side of the drum 1.

A stencil 8 is paid out from the stencil roll 9. The cutting means 13 is made up of a movable edge 13*a* and a stationary edge 13*b*. The stencil roll 9 has its core 9*a* rotatably supported by holder means, not shown.

A rotatable press roller or pressing means 16 is located below the drum 1. Moving means, not shown, angularly moves the press roller 16 between a position where the outer periphery of the roller 16 is spaced from the outer periphery of the drum 1 and a position where the former contacts the latter.

Figure 1:
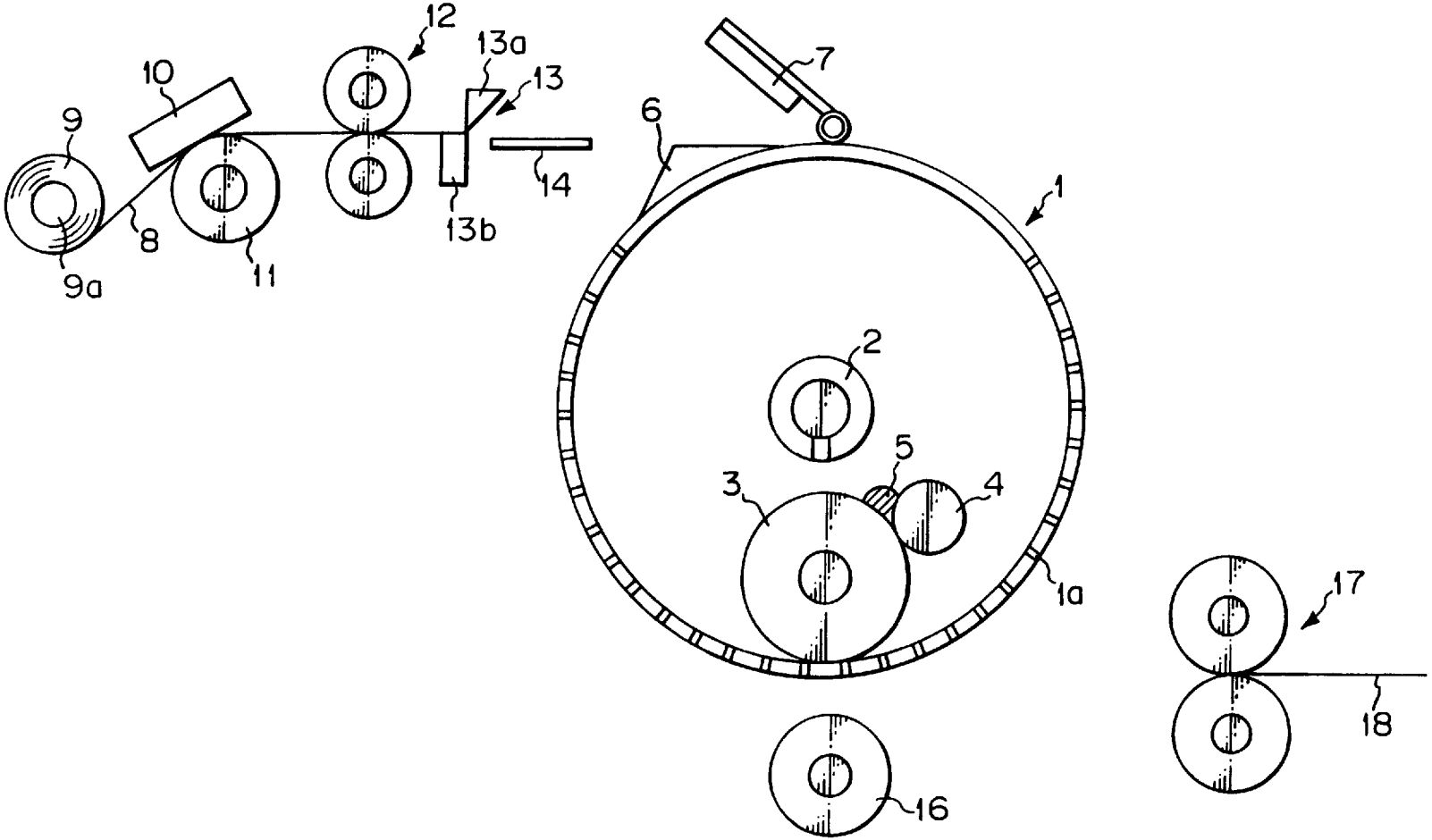
FIG. 1 is a fragmentary side elevation of a stencil printer incorporating a first embodiment of the present invention.

A registration roller pair 17 is positioned at the right-hand side of the press roller 16, as viewed in FIG. 1. When a paper 18 is fed from paper feeding means, not shown, to the roller pair 17, the roller pair 17 nips the leading edge of the paper 18. Then, the roller pair 17 conveys the paper 18 to between the drum 1 and the press roller 16 in synchronism with the movement of the roller 16 into contact with the drum 1. The press roller 16 may be replaced with a press drum having substantially the same diameter as the drum 1, if desired.

Figure 3:
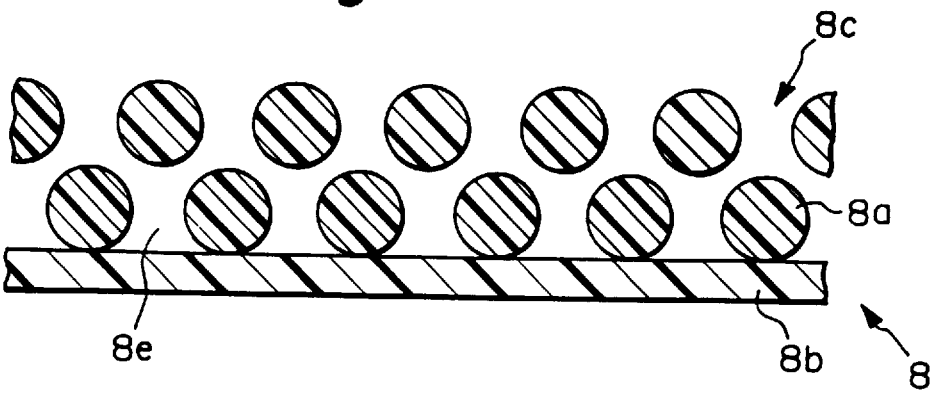
FIG. 3 is a fragmentary section of a stencil representative of the first embodiment

As shown in FIG. 3, the stencil 8 is made up of a porous substrate 8*c* implemented by an unwoven cloth and a film 8*b* made of polyester or similar thermoplastic resin. The substrate 8*c* and film 8*b* are joined with each other by an adhesive. The substrate or unwoven cloth 8*c* has fibers 8*a* which are Japanese paper fibers or similar natural fibers, or Tetron (trade name), nylon (trade name) or similar synthetic resin fibers. The fibers 8*a* form passageways for passing the ink. If desired, the substrate 8*c* may be implemented by a porous thin sheet of kozo, mitsumata, Manila hemp, flax or similar natural fibers, an unwoven cloth of rayon (trade name), vinylon (trade name), fluorine-contained resin, polyester or similar synthetic resin fibers, or an unwoven cloth formed of a mixture of natural fibers and synthetic resin fibers.

The thermal head 10 and platen roller 11 are mounted on side walls, not shown, included in the printer. The head 10 has a number of heating elements and is urged against the roller 11 by biasing means, not shown. The roller 11 is rotated clockwise, as viewed in FIG. 1, by a stepping motor, not shown. The stencil 8 is paid out from the roll 9 by the roller 11. The stencil 8 has its film 8*b* pressed against the head 10 and perforated thereby.

The conveyor roller pair 12 is also journalled to the side walls of the printer and positioned downstream of the head 10 and platen roller 11 with respect to the direction of stencil transport. Driving means, not shown, rotates the roller pair 12 at a peripheral speed slightly higher than the peripheral speed of the platen roller 11. A torque limiter, not shown, is associated with the roller pair 12 and applies a preselected tension to the portion of the stencil 8 intervening between the platen roller 11 and roller pair 12.

The cutting means 13 and stencil guide 14 are positioned downstream of the above roller pair 12 with respect to the direction of stencil transport. The movable edge 13*a* of the cutting means 13 is rotatable or movable in the up-and-down direction toward and away from the stationary edge 13*b* so as to cut the perforated stencil 8. This kind of configuration is conventional. The guide 14 is affixed to the side walls of the printer and guides the stencil 8 being conveyed away from the cutting means 13.

In operation, when the operator sets a document on a document scanning section, not shown, and then presses a perforation start key, not shown, the drum 1 is rotated. A master discharging device, not shown, separates a used master from the outer periphery of the drum 1 and discharges it. The rotation of the drum I is stopped when the damper 7 reaches a position right above the axis of the drum 1. Then, the opening and closing means opens the clamper 7. In this condition, the drum 1 waits for the perforated stencil or master 8.

The discharge of the used master is followed by the perforation of the stencil 8. A document image read by the scanning section is transformed to an electric signal by, e.g., a CCD (Charge Coupled Device) image sensor. The electric signal is sent to a perforation control unit, not shown, via an analog-to-digital converter as image data. In response, the perforation control unit selectively feeds a current in the form of pulses to the heating elements of the head 10 in accordance with the image data. As a result, the head 10 perforates the film 8*b* of the stencil 8 by heating it. Before the operation of the head 10, the platen roller 11 is rotated by the stepping motor so as -to pay out the stencil 8 from the roll 9.

The perforated portion of the stencil 8 is conveyed to the damper 7 by the roller pair 12 while being guided by the guide 14. Whether or not the leading edge of the stencil 8 has arrived at a preselected position between the damper 7 and the stage 6 is determined on the basis of the number of steps of the stepping motor which drives the platen roller 11. On the arrival of the stencil 8 at the above position, the opening and closing means rotates the damper 7 counterclockwise and thereby causes it to clamp the leading edge of the stencil 8 in cooperation with the stage 6. Subsequently, the drum 1 is again rotated clockwise at a peripheral speed substantially equal to the stencil conveying speed, so that the stencil 8 begins to be wrapped around the drum 1. When the entire document image has been formed in the stencil 8, as also determined on the basis of the number of steps of the above stepping motor, the rotation of the platen roller 11 and that of the roller pair 12 are stopped. Then, the cutting means 13 cuts the stencil 8. The cut length of the stencil or master 8 is pulled out by the rotation of the drum 1 and fully wrapped around the drum 1.

After the master 8 has been wrapped around the drum 1, the printer produces a trial printing, as follows. The paper 18 fed from the paper feeding means is nipped by the registration roller pair 17. The roller pair 17 drives the paper 18 to between the drum 1 and the press roller 16 at such a timing that the image area of the master 8 on the drum 1, which is rotating at a low speed at this stage, arrives at a position corresponding to the roller 16. The press roller 16 presses the paper 18 against the drum 1. Hence, the press roller 16, paper 18, master 8 and the outer periphery of the drum 1 are pressed against each other. As a result, the ink fed to the inner periphery of the drum 1 by the ink roller 3 oozes out via the pores 1*a* and the open area of the ink holding layer 15. After the ink has been filled in the open area of the layer 15 and bores 8*e* existing in the substrate 8*c* of the master 8, as shown in FIG. 3, it is transferred to the paper 18 via the perforations of the film 8*b* of the master 8.

The paper 18 carrying the ink thereon is separated from the drum I by a separator, not shown, and then driven out of the printer by discharging means as a trial printing.

After the trial printing, the operator presses a print start key. Then, the paper feeding means feeds papers 18 continuously. At this instant, the drum 1 is rotated at a high speed for thereby producing a desired number of printings.

of the substrate 8*c* and film 8*b*. After the measurement, adhesive is applied to the above-mentioned side of the substrate 8*c* in a thin layer, and then the film 8*b* is adhered to the same side to complete the stencil 8. The above conditions for the measurement of surface roughness also hold with a second embodiment to a sixth embodiment to be described. The film 8*b* is 1.5 μm thick. The results of experiments are listed in Table 1 below.

TABLE 1

| Diameter | Irregularity L (Roughness Rz) | Smear | Image | Diameter | Irregularity L (Roughness Rz) | Smear | Image |
|---|---|---|---|---|---|---|---|
| 50 μm | 60 μm | x | B | 7 μm | 14 μm | ☆ | A |
| 40 μm | 52 μm | x | A | 5 μm | 9 μm | ☆ | A |
| 30 μm | 49 μm | x | A | 4 μm | 8 μm | ☆ | A |
| 20 μm | 45 μm | Δ | A | 3 μm | 6 μm | ☆ | B |
| 15 μm | 35 μm | ○ | A | 1 μm | 5 μm | ☆ | B |
| 10 μm | 27 μm | ○ | A | 0.8 μm | 4 μm | ☆ | C |
| 8 μm | 25 μm | ☆ | A | | | | |

Figure 4:
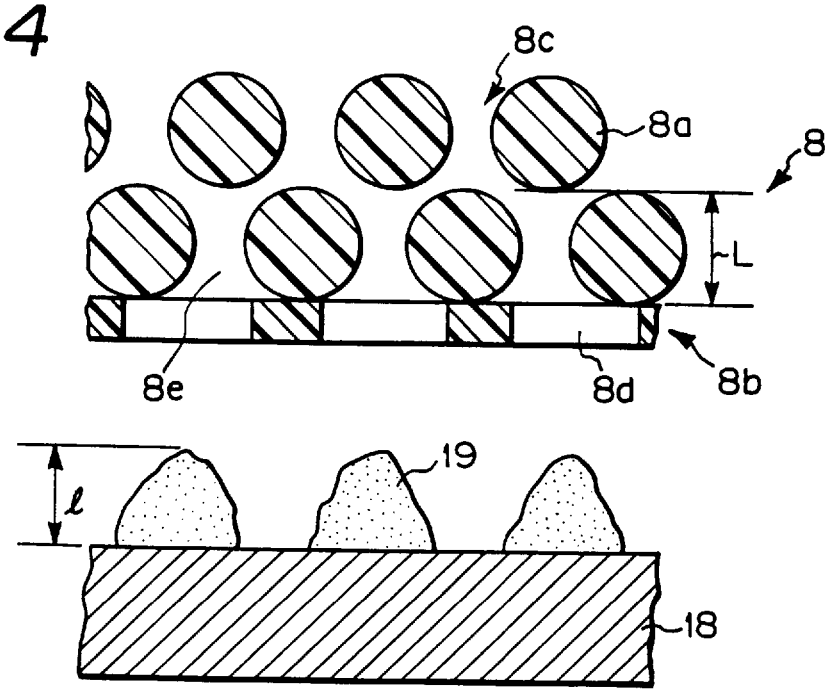
FIGS. 4–6 are fragmentary sectional side elevations each showing a particular condition of ink transfer to a paper in the first embodiment.
Figure 5:
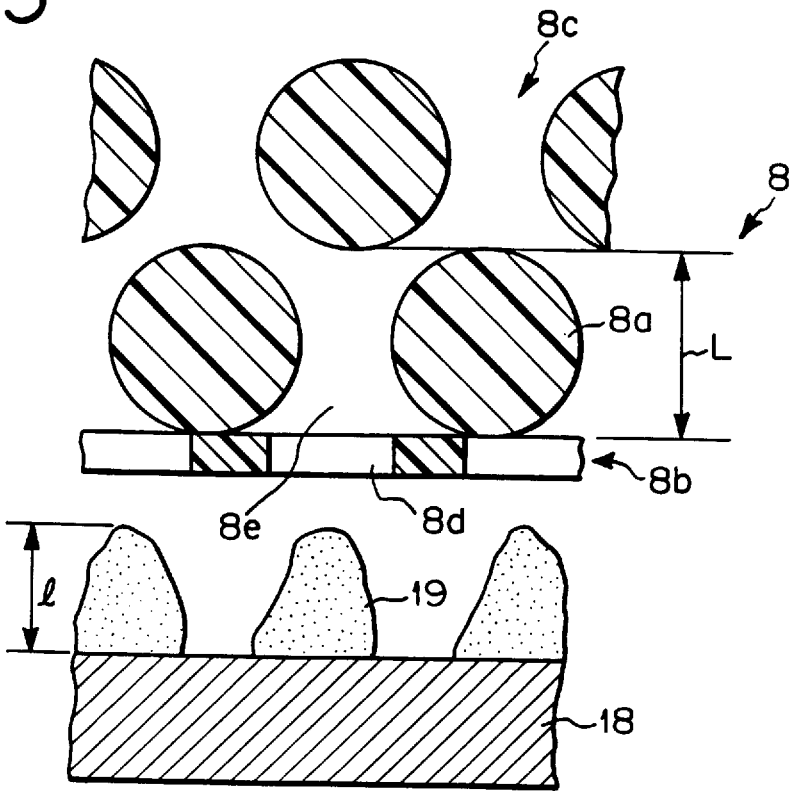
Figure 6:
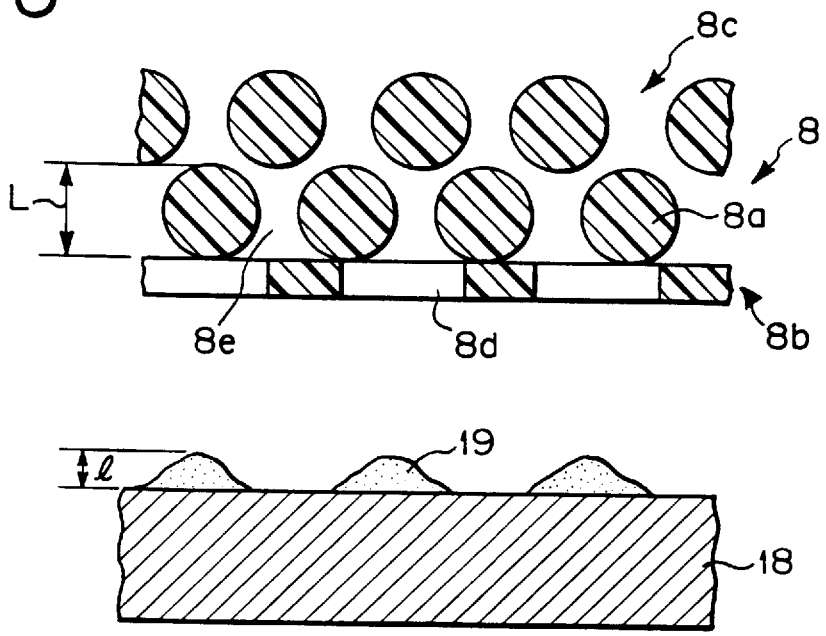

As shown in FIGS. 4, 5 and 6, when the paper 18 is separated from the drum 1 during the trial printing or the actual printing, the ink 19 is drawn out from the perforations 8*d* of the film 8*b* of the master 8 due to the adhesion acting between the ink existing on the surface of the master 8 and the paper 18. The amount in which the ink 19 is drawn out is related to the structure of the substrate 8*c;* that is, as the irregularity (surface roughness) L of the substrate 8*c* increases, the ink layer in the upper bores 8*e* increases in thickness, and therefore the amount of the ink 19 drawn out, i.e., the height l of ink transfer increases.

Specifically, as shown in FIGS. 4 and 5, as the irregularity or surface roughness L increases, the bores 8*e* overlying the perforations 8*d* where the ink 19 is present increase in size. As a result, the ink 19 is drawn out from the substrate 8*c* in a great amount via the perforations 8*d*. More specifically, the irregularity L and, therefore, the amount of the ink 19 drawn out is greater in the condition of FIG. 5 than in the condition of FIG. 4. As shown in FIG. 6, by reducing the diameter of the synthetic resin fibers 8*a,* it is possible to reduce the irregularity L, i.e., the amount of the ink 19 drawn out (height l of ink transfer). However, if the irregularity L is excessively small, the amount of the ink 19 to be drawn out will be too small for a satisfactory image to be reproduced on the paper 18. For experiments, use was made of porous substrates 8*c* which had a thickness of 100 μm and a density of 0.4 g/cm$^3$, but each had synthetic resin fibers 8*a* of particular diameter, i.e., irregularity L. With such substrates 8*c,* images were printed on papers and evaluated with regard to rear smearing.

The experiments were conducted by use of a digital stencil printer PRIPORT VT3820 (trade name) available from Ricoh Co., Ltd., and a surface roughness measuring device SEF-30D (trade name) available from Kosaka Laboratory Co., Ltd. For the measurement of the surface roughness, use was made of a head having a radius of 7 μm. The measurement was effected over a length of 0.8 mm at a feed rate of 0.1 mm/sec. A ten-point mean roughness was determined in the above range and then at ten different points. The ten-point mean roughnesses measured at the ten points were averaged to produce an irregularity L (surface roughness Rz). It is to be noted that the surface roughness refers to the surface roughness of the side of the substrate 8*c* contacting the film 8*b* and is measured before the adhesion In Table 1, crosses, triangles, circles and stars respectively indicate "much smearing", "little smearing", "almost no smearing", and "no smearing". Also, letters A, B and C respectively indicate "excellent image", "good image", and "poor image".

As Table 1 indicates, rear smearing was reduced when the surface roughness was less than 45 μm Rz inclusive, almost none when it was less than 35 μm Rz inclusive, or none when it was less than 25 μm Rz inclusive. When the surface roughness was less than 5 μm Rz, a satisfactory image was not obtained. Further, the smearing was reduced when the diameter of the fibers 8*a* was less than 20 μm inclusive, almost none when it was less than 15 μm inclusive, or none when it was less than 8 μm inclusive. In addition, when the fiber diameter was less than 1 μm, a satisfactory image was not obtained.

In light of the above, the substrate 8*c* is provided with a surface roughness ranging from 5 μm Rz to 45 μm Rz, preferably 5 μm Rz to 35 μm Rz or more preferably 5 μm Rz to 25 μm Rz, as measured at the side contacting the film 8*b*. Also, the substrate 8*c* is provided with a fiber diameter greater than 1 μm inclusive, but smaller than 20 μm inclusive, preferably greater than 1 μm inclusive, but smaller than 15 μm inclusive or more preferably greater than 1 μm inclusive, but smaller than 8 μm inclusive.

If the density of the substrate 8*c* is small, the bores 8*e* between the fibers 8*a* increase in size; even if thin fibers are used, the irregularity L increases and aggravates the rear smearing. If the density of the substrate 8*c* is great, the bores 8*e* decrease in size and obstruct the passage of the ink at portions where a great number of fibers 8*a* intersect each other, resulting in the local omission of an image (fiber marks). A series of experiments were conducted in order to determine a relation between the density of the substrate 8*c* and the rear smearing. The results of experiments are as follows. The density should preferably be 0.1 g/cm$^3$ to 0.6 g/cm$^3$, more preferably 0.2 g/cm$^3$ to 0.6 g/cm$^3$, when the substrate 8*c* is implemented by natural fibers or synthetic resin fibers. The density should preferably be 0.7 g/cm$^3$ to 3.0 g/cm$^3$, more preferably 0.9 g/cm$^3$ to 3.0 g/cm$^3$, when the substrate 8*c* is implemented by stainless steel or iron fibers. The density should preferably be 0.4 g/cm$^3$ to 1.7 g/cm$^3$, more preferably 0.5 g/cm$^3$ to 1.7 g/cm$^3$, when the substrate 8*c* is implemented by titanium fibers. Further, the density should preferably be 0.2 g/cm$^3$ to 1.0 g/cm$^3$, more preferably 0.3 g/cm$^3$ to 1.0 g/cm$^3$, when the substrate 8*c* is implemented by aluminum fibers.

It follows that the substrate 8*c* has a preferable density range Dw and a more preferable density range Dw1 expressed as:

$$Dw=0.09\ \rho\sim0.38\ \rho(g/cm^3)$$

$$Dw1=0.11\ \rho\sim0.38\ \rho(g/cm^3)$$

where ρ is the density of a substance (g/cm$^3$).

The above equations are also true with the second embodiment to a fifteenth embodiment and their modifications to be described.

In the above embodiment, the substrate 8*c* is implemented by an unwoven cloth. If desired, the unwoven cloth may be replaced with a mesh screen of Manila hemp, flax or similar natural fibers, Tetron (trade name), nylon (trade name) or similar synthetic resin fibers, or stainless steel, iron, copper, nickel, aluminum, titanium or similar metal fibers, an unwoven cloth of stainless steel, iron, copper, nickel, aluminum, titanium or similar metal fibers, a sheet formed by sintering Tetron (trade name), nylon (trade name) or similar synthetic resin fibers, a polyvinyl acetal- or polyvinyl alcohol-based porous elastic member having continuous bubbles, a porous elastic member which is a mixture of hard grain and rubber and has continuous bubbles, a porous elastic member formed by sintering the fine powder of polyethylene or similar synthetic resin or inorganic substance, a porous elastic member formed by liquid-sintering polyurethane or the like, or a porous elastic member made of porous rubber or the like.

Further, the above mesh screens, unwoven cloths, sintered sheets and various porous elastic members may each have a porous substrate provided with the fine powder of, e.g., metal or resin on its side contacting the thermoplastic resin film by dispersion, melting, or adhesion. Then, the substrate will have its surface roughness reduced.

Figure 7:
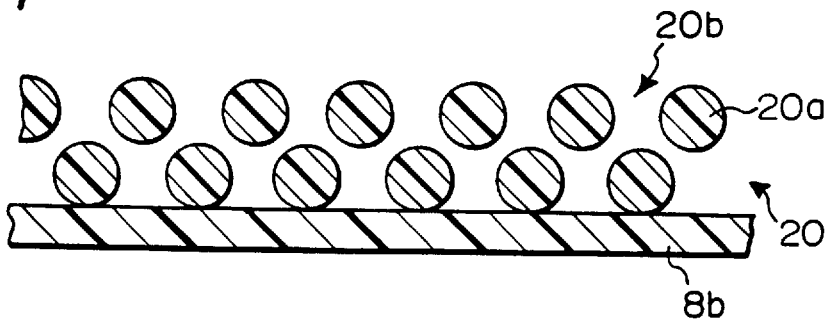
FIG. 7 is a fragmentary sectional side elevation of a stencil representative of a second embodiment.
Figure 8:
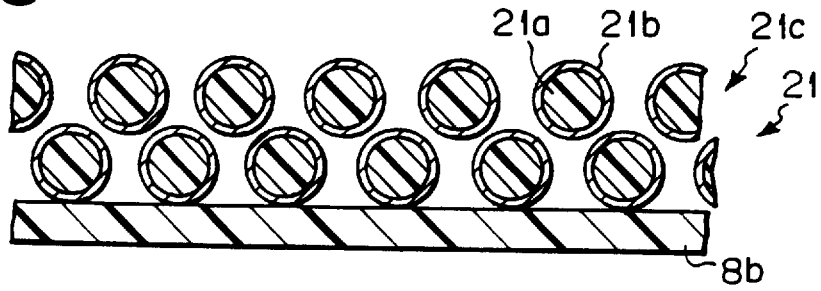
FIG. 8 is a fragmentary sectional side elevation of a stencil representative of a modification of the second embodiment.

FIG. 7 shows a stencil 20 representative of a second embodiment of the present invention while FIG. 8 shows a stencil 21 representative of a modification thereof. The embodiment and its modification to be described are identical with the first embodiment except that the stencils 20 and 21 are each substituted for the stencil 8.

As shown, the stencil 20 is made up of a porous substrate 20*b* implemented by a sintered sheet of stainless steel, iron, copper, nickel, aluminum, titanium or similar metal fibers 20*a,* and the thermoplastic resin film 8*b* adhered to the substrate 20*b*. On the other hand, the stencil 21 is made up of a porous substrate 21*c* and the film 8*b* adhered thereto. The substrate 21*c* is a sintered sheet implemented by Tetron (trade name), nylon (trade name) or similar synthetic resin fibers 21*a* coated with stainless steel, iron, copper, nickel, aluminum, titanium or similar metal 21*b*.

The substrates 20*b* and 21*c* are each provided with a surface roughness of 5 μm Rz to 45 μm Rz, preferably 5 μm Rz to 35 μm Rz, more preferably 5 μm Rz to 25 μm Rz, as measured at the side contacting the film 8*b*. Also, the substrates 20*b* and 21*c* each has a fiber diameter greater than 1 μm inclusive, but smaller than 20 μm inclusive, preferably greater than 1 μm inclusive, but smaller than 15 μm inclusive or more preferably greater than 1 μm inclusive, but smaller than 8 μm inclusive, as measured at the side contacting the film 8*b*. Each of the substrates 20*b* and 21*c* is formed by sintering an unwoven cloth of metal fibers 20*a* or an unwoven cloth of synthetic resin fibers 21*a* coated with the metal 21*b*. These substrates 20*b* and 21*c* each has a high energy surface and high wettability and enhances the adhesion of the ink thereto. This successfully reduces the amount in which the ink is drawn out of the substrate 20*b* or 21*c,* thereby obviating rear smearing.

The substrates 20*b* and 21*c* are more elastic than a porous substrate constituted by natural fibers or synthetic resin fibers. This is desirable from the following respect. Assume that the press roller or similar pressing member is pressed against the substrate 20*b* or 21*c* to cause it to discharge the ink, and then released therefrom. Then, the substrate 20*b* or 21*c* is elastically restored while sucking the ink thereinto. As a result, the excessive transfer of the ink to the paper which would bring about rear smearing is obviated. Further, because the substrates 20*b* and 21*c* are more strong than the porous substrate of natural fibers or synthetic resin fibers, they yield little even when used over a long period of time. Therefore, stencils 20 and 21 including the substrates 20*b* and 21*c,* respectively, are durable and feasible for mass printing.

In the second embodiment and its modification, the substrates 20 and 21 are respectively comprised of the sintered sheet of metal fibers 20*a* and the sintered sheet of synthetic resin fibers 21*a* coated with the metal 21*b*. However, use may be made of any other kind of substrate so long as it has a metallic surface and has passageways for the ink to pass, e.g., an unwoven cloth of metal fibers, an unwoven cloth of synthetic resin fibers whose surface is coated with metal, a mesh screen of metal fibers, or a porous member formed by sintering fine powder of metal. A sintered sheet is particularly desirable because it is greater in tensile strength than unwoven cloths and is lower in cost than mesh screens.

Figure 9:
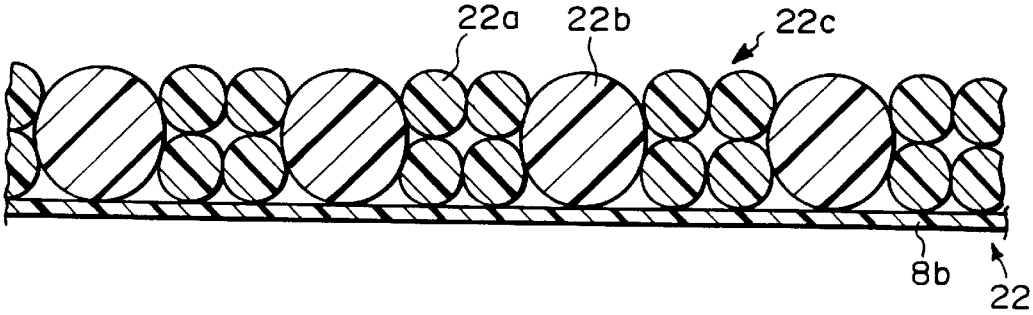
FIG. 9 is a fragmentary sectional side elevation of a stencil representative of a third embodiment.
Figure 10A:
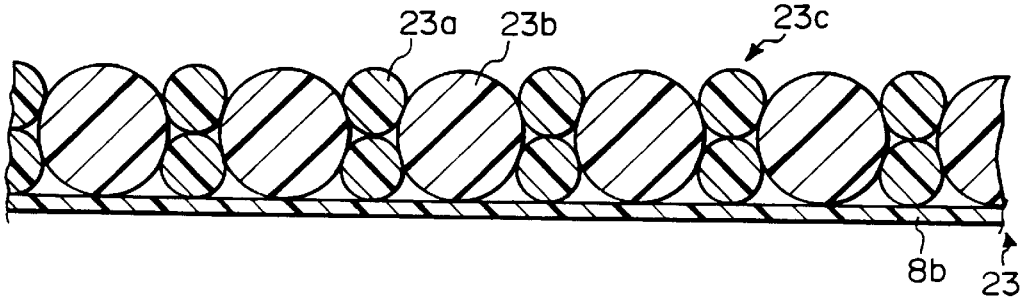
FIGS. 10A and 10B are fragmentary sectional side elevations each showing a particular modification of the third embodiment.

FIG. 9 shows a stencil 22 representative of a third embodiment while FIG. 10A shows a stencil 23 representative of a modification thereof. The embodiment and its modification to be described are identical with the first embodiment except that the stencil 22 and 23 are each substituted for the stencil 8.

The stencil 22 has a porous substrate 22*c* which is an unwoven cloth made up of two different kinds of synthetic resin fibers 22*a* and 22*b* each having a particular diameter. The nearby fibers 22*b* sandwich two arrays of fibers 22*a*. Likewise, the stencil 23 has a porous substrate 23*c* which is an unwoven cloth made up of two different kinds of synthetic resin fibers 23*a* and 23*b* each having a particular diameter, but the nearby fibers 23*b* sandwich a single array of fibers 23*a*. The film 8*b* is adhered to each of the substrates 22*c* and 23*c*.

In the above embodiment and its modification, the fibers 22*a* and 23*a* each has a diameter of 4 μm while the fibers 22*b* and 23*b* each has a diameter of 8 μm. The diameter and mixture ratio of the synthetic resin fibers are selected such that each substrate 22*c* or 23*c* can be provided with a surface roughness of 5 μm Rz to 45 μm Rz, preferably 5 μm Rz to 35 μm Rz or more preferably 5 μm Rz to 25 μm Rz, as measured at the side contacting the film 8*b*. The synthetic resin fibers are selected such that their diameter is greater than 1 μm inclusive, but smaller than 20 μm inclusive, preferably greater than 1 μm inclusive, but smaller than 15 μm or more preferably greater than 1 μm inclusive, but smaller than 8 μm, as measured at the side contacting the film 8*b*. If desired, three or more different kinds of synthetic resin fibers may be combined.

Each stencil 22 or 23 having the above configuration has its bores between the thick fibers filled with the thin fibers. This successfully reduces the irregularity L (surface roughness Rz) of the substrates 22*c* and 23*c*. In addition, the thick fibers increases the tensile strength of the stencils 22 and 23.

The substrates or unwoven cloths 22*c* and 23*c* consisting of the synthetic resin fibers 22*a* and 22*b* and synthetic resin fibers 23*a* and 23*b* may each be replaced with any one of the substitutes mentioned in relation to the second embodiment, e.g., a sintered sheet of metal fibers, a sintered sheet of synthetic resin fibers whose surface is coated with metal, an unwoven cloth or mesh screen of metal fibers, an unwoven cloth or mesh screen of synthetic fibers whose surface is coated with metal, or such a sintered sheet, unwoven cloth or mesh screen in which fine powder of metal or resin is dispersed, melted or adhered between the synthetic resin fibers and the metal fibers. These substitutes are also constituted by two or more different kinds of fibers each having a particular diameter.

Figure 10B:
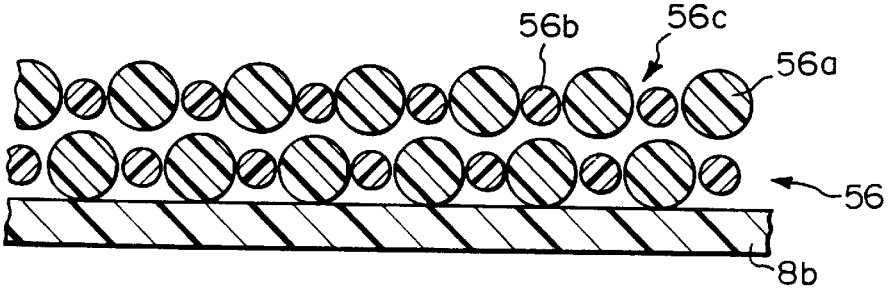

FIG. 10B shows another modification of the third embodiment. As shown, a stencil 56 has a porous substrate 56*c* and film 8*b* adhered thereto. The substrate 56*c* is an unwoven cloth consisting of thick synthetic resin fibers 56*a* and thin synthetic resin fibers 56*b* arranged in a zig-zag configuration.

Figure 11:
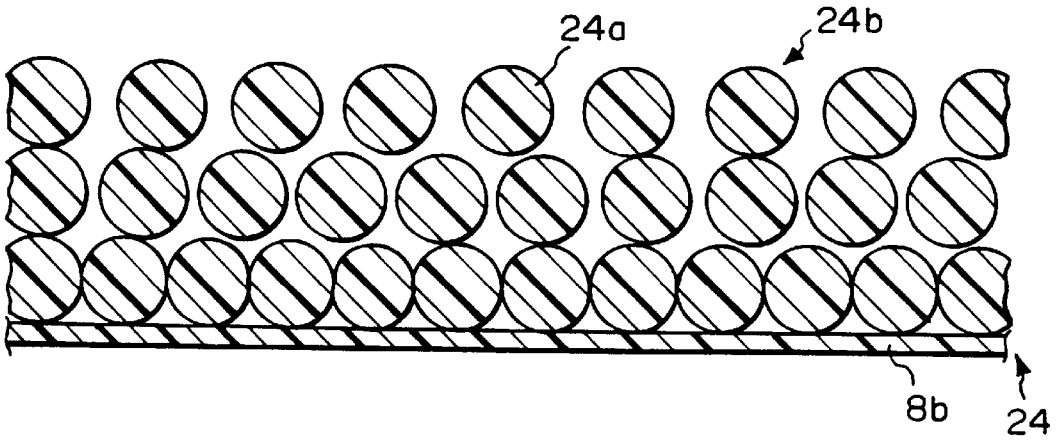
FIG. 11 is a fragmentary sectional side elevation of a stencil representative of a fourth embodiment.
Figure 12:
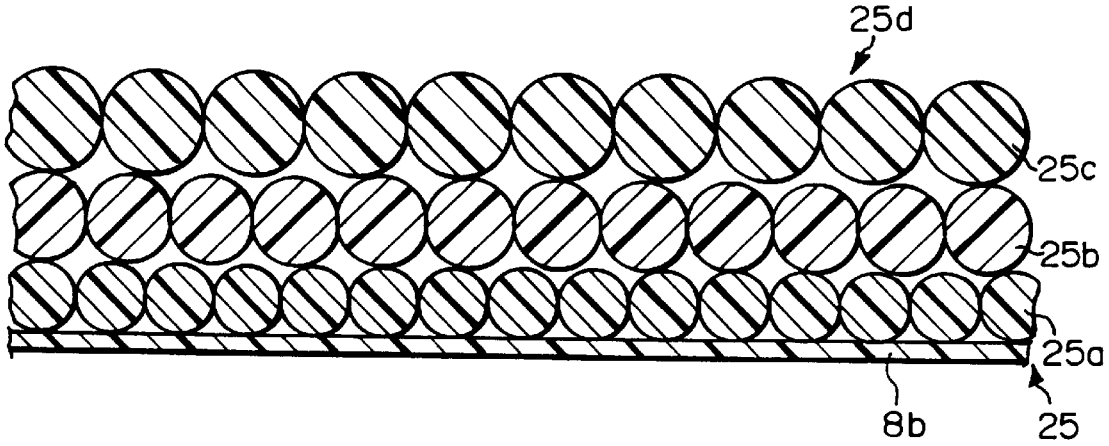
FIG. 12 is a fragmentary sectional side elevation of a stencil representative of a fifth embodiment.

FIGS. 11 and 12 respectively show a stencil 24 representative of a fourth embodiment and a stencil 25 representative of a fifth embodiment. The embodiments to be described are identical with the first embodiment except that the stencils 24 and 25 are each substituted for the stencil 8.

In FIG. 11, the stencil 24 has a porous substrate 24*b* which is an unwoven cloth made up of of a plurality of layers of identical synthetic resin fibers 24*a*. The film 8*b* is adhered to the substrate 24*b*. It is noteworthy that the density of the fibers 24*a* sequentially decreases from the outermost fiber layer contacting the film 8*b* to the innermost fiber layer.

In FIG. 12, the stencil 25 has a porous substrate 25*d* which is an unwoven cloth made up of synthetic resin fibers 25*a*, 25*b* and 25*c* arranged in layers and each having a particular diameter. The film 8*b* is adhered to the substrate 25*d*. The fibers 25*a* constituting the outermost layer which contacts the film 8*b* has the smallest diameter. The fiber diameter sequentially increases from the outermost layer to the innermost layer which is formed by the fibers 25*c*.

In each of the substrates 24*b* and 25*d*, the bores sequentially decrease in size from the side where the substrate 24*b* or 25*d* does not contact the film 8*b* toward the side where the former contacts the latter.

In the stencils 24 and 25, the substrates 24*b* and 25*d* each has a surface roughness of 5 μm Rz to 45 μm Rz, preferably 5 μm Rz to 35 μm Rz or more preferably 5 μm Rz to 25 μm Rz, as measured on the surface contacting the film 8*b*. The synthetic resin fibers 24*a* and 25*a* are selected such that their diameter is greater than 1 μm inclusive, but smaller than 20 μm inclusive, preferably greater than 1 μm inclusive, but smaller than 15 μm inclusive or more preferably greater than 1 μm inclusive, but smaller than 8 μm inclusive, as measured at least on the surface contacting the film 8*b*.

While the fibers 24*a* and the fibers 25*a*–25*c* are each arranged in three layers, they may be laminated in any desired number of layers if it is two or more.

In each of the stencils 24 and 25, the ink is easily fed and spread in the initial part of the passageways due to the great bores. In the last part of the passageways, the irregularity L of the substrates 24*b* and 25*b* is small due to the small bores.

Again, the substrates 24*b* and 25*d* shown and described may each be replaced with any one of the substitutes mentioned in relation to the second embodiment, e.g., a sintered sheet of metal fibers, a sintered sheet of synthetic resin fibers whose surface is coated with metal, an unwoven cloth or a mesh screen of metal fibers, an unwoven cloth or a mesh screen of synthetic resin fibers whose surface is coated with metal, such a sintered sheet, unwoven cloth or mesh screen in which fine powder of metal or resin is dispersed, melted or adhered between the synthetic resin fibers and the metal fibers, or a porous member produced by sintering fine powder of metal. The crux is that the surface of the substrate is formed by metal. Even these substitutes are each configured such that the bores sequentially decrease in size from the side not contacting the film to the side contacting it. Further, use may be made of the porous elastic member having continuous bubbles, or the porous elastic member formed by liquid sintering, as also mentioned in the first embodiment.

Figure 13:
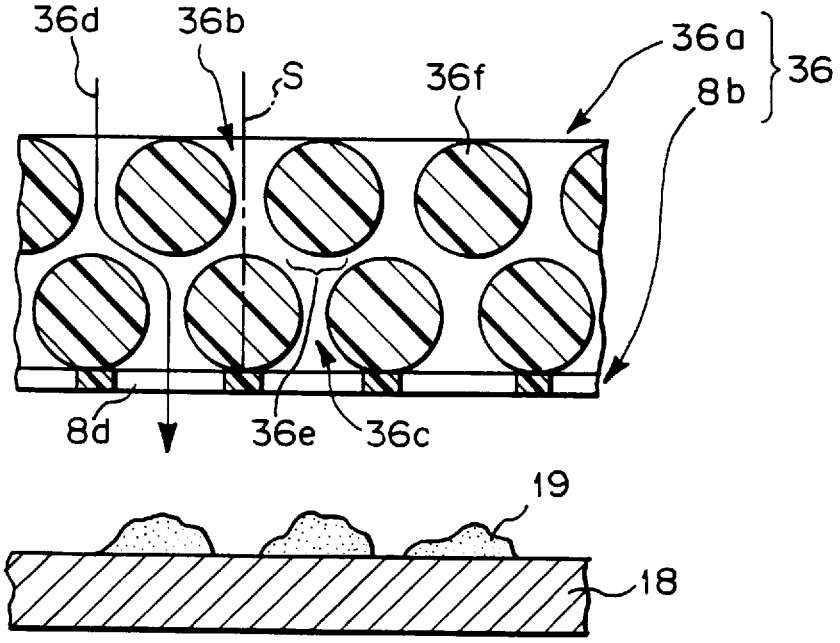
FIG. 13 is a fragmentary sectional side elevation of a stencil representative of a sixth embodiment.

FIG. 13 shows a stencil 36 representative of a sixth embodiment. This embodiment is identical with the first embodiment except that the stencil 36 is substituted for the stencil 8. As shown, the stencil 36 has a porous substrate 36*a* which is an unwoven cloth mainly constituted by fiber members 36*f*. Ink passageways 36*d* are formed in the substrate 36*a* such that the ink flown into the substrate 36*a* via an inlet pore 36*b* is deflected at least once from a vertical S extending to the plane in which the film 8*b* and substrate 36*a* contact, and then flows out via an outlet pore 36*c*. In this configuration, the ink flown into the substrate 36*a* via the pore 36*b* is substantially entirely blocked by the fiber member 36*f* existing on the vertical S and prevented from flowing down along the vertical S thereby. Stated another way, substantially the entire ink entered the pore 36*b* is caused to flow outward away from the vertical S due to the fiber member 36*f*, and then flow downward toward the pore 36*c*.

When the paper 18 is separated from the surface of the stencil 36, the adhering force of the ink 19 acts between the ink 19 and the ceiling portion 36*e* of the pore 36*c*. As a result, the amount on which the ink 19 is drawn out from the substrate 36*a* is reduced. In FIG. 13, the stencil 36 is shown as having the perforations 8*d* formed therein.

Specific methods for determining whether or not the above ink passageways 36*d* have been successfully formed in the substrate 36*a* will be described hereinafter.

Figure 14:
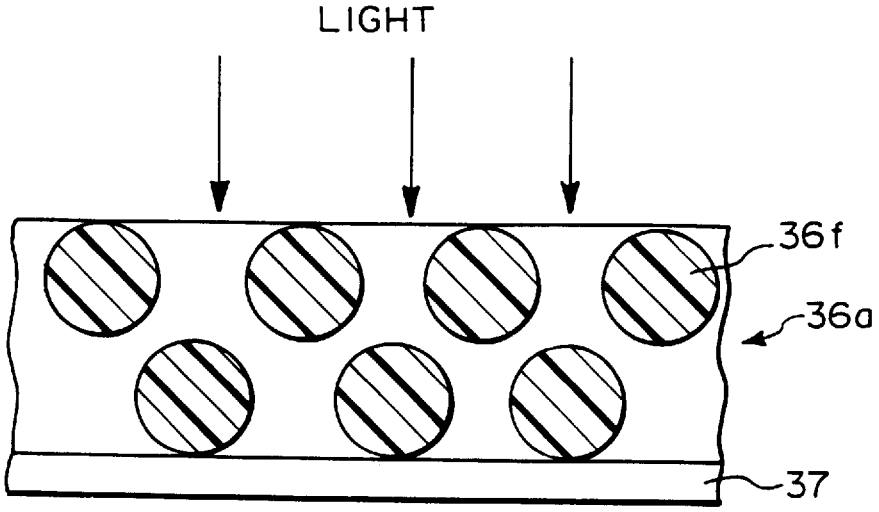
FIGS. 14 and 15 are fragmentary sectional side elevations for describing the stencil of the sixth embodiment.

As shown in FIG. 14, a paper 37 different in color from the substrate 36*a* is adhered to the rear of the substrate 36*a*. In this condition, the substrate 36*a* and paper 37 are observed through a microscope with 50 magnifications while being illuminated from the substrate side. If the paper 37 is not visible through between the fiber members 36*f*, it can be determined that the desired passageways 36*d* have been formed.

Figure 15:
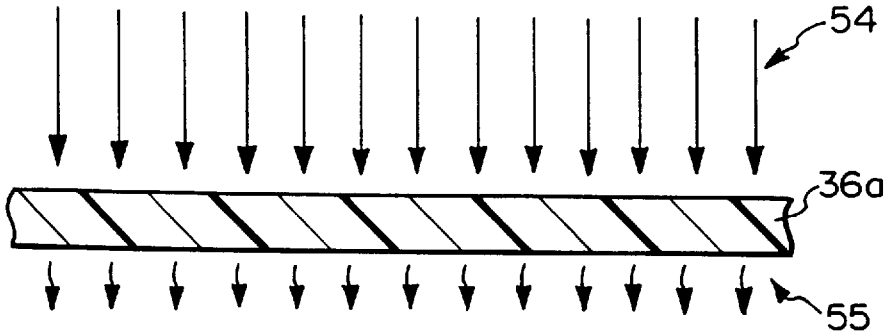

FIG. 15 shows an alternative method. As shown, parallel rays 54 are emitted toward the substrate 36*a* from one side of the substrate 36*a*. Light 55 reaching the other side of the substrate 36*a* is measured by an actinometer, e.g., laser type sensor LX2-100 (trade name) available from Keyence Inc. Because the parallel rays 54 are reflected in the passageways 36*d*, they do not reach the other side of the substrate 36*a*. Hence, if the light 55 is not measured by the actinometer, it can be determined that the desired passageways 36*d* have been formed.

Figure 16:
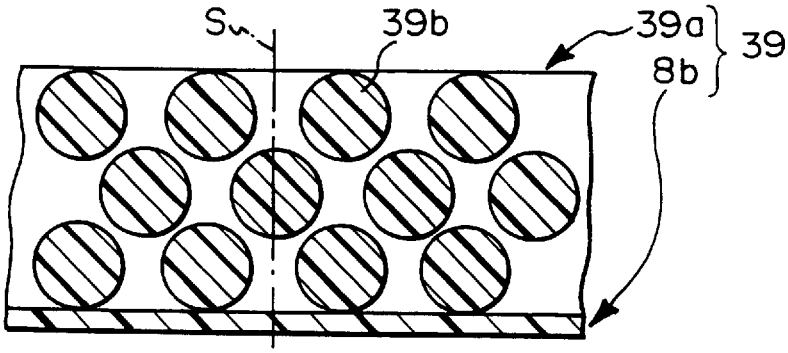
FIG. 16 is a fragmentary sectional side elevation representative of a modification of the sixth embodiment.

As shown in FIG. 16, in a modification of this embodiment, a stencil 39 has a porous substrate 39*a* made up of fiber members 39*b* similar to the fiber members 36*f* and laminated in three or more layers.

In the illustrative embodiment and its modification, the porous substrates 36*a* and 39*a* each has a surface roughness of 5 μm Rz to 45 μm Rz, preferably 5 μm Rz to 35 μm Rz or more preferably 5 μm Rz to 25 μm Rz, as measured on the side contacting the film 8*b*. Also, the fiber members 36*f* and 39*b* have a diameter of greater than 1 μm inclusive, but smaller than 20 μm inclusive, preferably greater than 1 μm inclusive, but smaller than 15 μm inclusive or more preferably greater than 1 μm inclusive, but smaller than 8 μm inclusive, as measured at least on the surface contacting the film 8*b*. Further, each of the fiber members 36*f* and 39*b* may be implemented as two or more different kinds of fiber members each having a particular diameter.

Further, as in the fourth and fifth embodiments, the density of the substrates 36*a* and 39*a* or the diameter of the fibers 36*f* and 39*b* may be changed such that the bores sequentially decrease in size toward the side contacting the film 8*b*. The substrates 36*a* and 39*a* may each be replaced with a porous substrate consisting of metal fibers or fibers coated with metal, a porous substrate formed by sintering fine powder of metal, or similar porous substrate at least the surface of which is formed of metal. In addition, for the porous substrate, use may be made of the porous elastic member having continuous bubbles, or a porous elastic member formed by liquid sintering, as mentioned in relation to the first embodiment.

Figure 17:
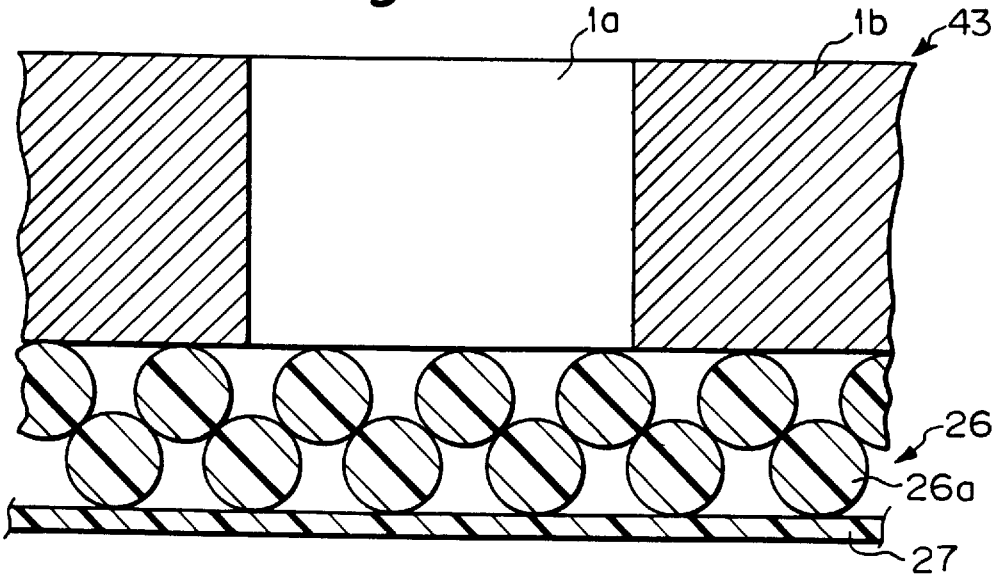
FIG. 17 is a fragmentary sectional side elevation of a drum and an ink holding member representative of a seventh embodiment.

FIG. 17 shows a drum 43 and a stencil or master 27 implemented only by a thermoplastic resin film. The drum 43 and stencil 43 are representative of a seventh embodiment of the present invention. As shown, this embodiment is identical with the first embodiment except that the drum 43 and stencil 27 are substituted for the drum 1 and stencil 8, respectively. The drum 43 is made up of the hollow cylindrical porous support 1*b* formed with the pores 1*a* (only one is shown), and an ink holding member 26.

The ink holding member 26 is an unwoven cloth of Tetron (trade name), nylon (trade name) or similar synthetic resin fibers 26*a* and having ink passageways formed therein.

When the member 26 is constituted by, e.g., synthetic resin fibers or natural fibers, its density should preferably be 0.1 g/cm$^3$ to 0.6 g/cm$^3$, more preferably 0.2 g/cm$^3$ to 0.6 g/cm$^3$. When the member 26 is formed of stainless steel or iron, the density should preferably be 0.7 g/cm$^3$ to 3.0 g/cm$^3$, more preferably 0.9 g/cm$^3$ to 3.0 g/cm$^3$. When the member 26 is formed of titanium, the density should preferably be 0.4 g/cm$^3$ to 1.7 g/cm$^3$, more preferably 0.5 g/cm$^3$ to 1.7 g/cm$^3$. Further, when the member 26 is formed of aluminum, the density should preferably be 0.2 g/cm$^3$ to 1.0 g/cm$^3$, more preferably 0.3 g/cm$^3$ to 1.0 g/cm$^3$.

As in the first embodiment, the preferable density range Dw and more preferable density range Dw1 of the ink holding member 26 are expressed as:

$$Dw=0.09\ \rho\sim0.38\ \rho(g/cm^3)$$

$$Dw1=0.11\ \rho\sim0.38\ \rho(g/cm^3)$$

where ρ is the density of a substance (g/cm$^3$).

Figure 18A:
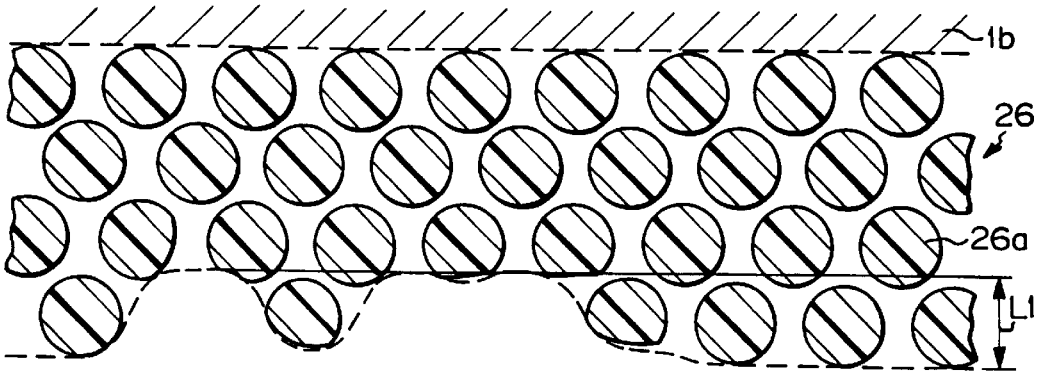
FIG. 18A is a fragmentary sectional side elevation showing an irregularity existing on the surface of an ink holding layer included in the seventh embodiment and ascribable to recesses.
Figure 18B:
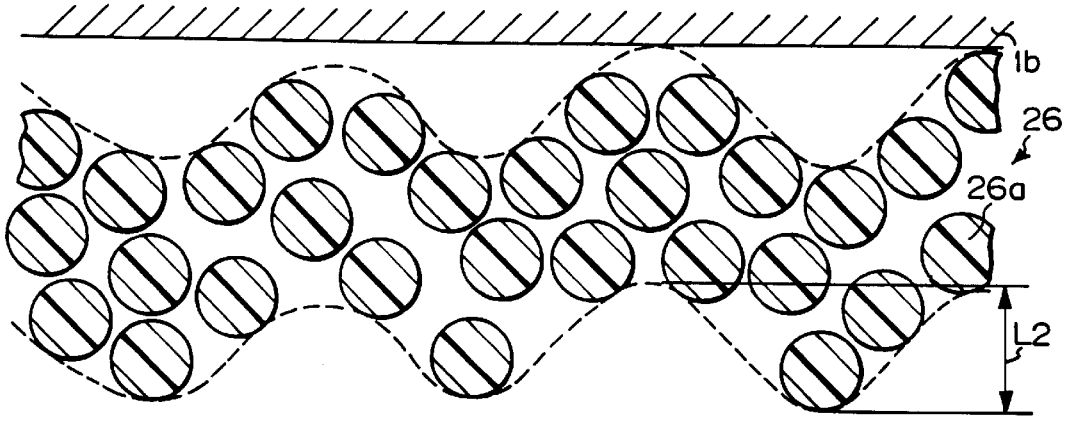
FIG. 18B is a fragmentary sectional side elevation showing an irregularity of the ink holding layer and ascribable to waving.
Figure 18C:
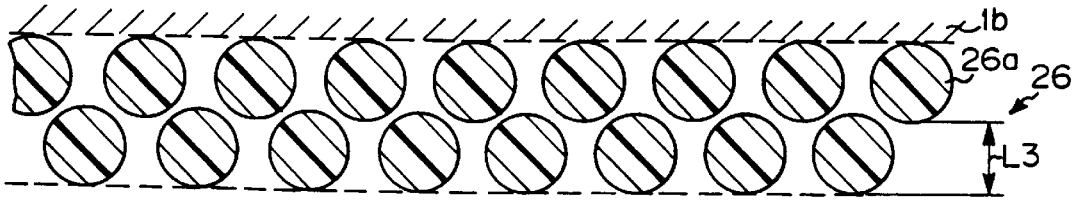
FIG. 18C is a fragmentary sectional side elevation showing an irregularity of the ink holding layer and ascribable to the diameter of synthetic resin fibers.

Because the stencil 27 lacks a porous substrate, the ink holding member 26, like the substrate 8*c* of the first embodiment, prevents the ink from being drawn out in an excessive amount. However, the member 26 has an irregularity L1 shown in FIG. 18A and ascribable to recesses, an irregularity L2 shown in FIG. 18B and ascribable to waving, and an irregularity L3 shown in FIG. 18C and ascribable to the diameter of the fibers 26*a*.

In light of the above, experiments were conducted by use of ink holding members 26 having a thickness of 100 μm and a density of 0.4 g/cm$^3$, and each having a particular diameter. The irregularities L of the members 26 were adjusted in order to determine the degrees of rear smearing. The experiments were conducted by use of a digital stencil printer PRIPORT VT3820 (trade name) available from Ricoh Co., Ltd., and a surface roughness measuring device SEF-30D (trade name) available from Kosaka Laboratory Co., Ltd. For the measurement of the surface roughness, use was made of a head having a radius of 7 μm. The measurement was effected over a length of 0.8 mm at a feed rate of 0.1 mm/sec. A ten-point mean roughness was determined in the above range and then at ten different points. The ten-point mean roughnesses measured at the ten points were averaged to produce an irregularity L (surface roughness Rz). The stencil 27 was 1.5 μm thick. The results of experiments are listed in Table 2 below,

TABLE 2

| Diameter | Irregularity L (Roughness Rz) | Smear | Image | Diameter | Irregularity L (Roughness Rz) | Smear | Image |
|---|---|---|---|---|---|---|---|
| 50 μm | 60 μm | x | B | 7 μm | 14 μm | ☆ | A |
| 40 μm | 52 μm | x | A | 5 μm | 9 μm | ☆ | A |
| 30 μm | 49 μm | x | A | 4 μm | 8 μm | ☆ | A |
| 20 μm | 45 μm | Δ | A | 3 μm | 6 μm | ☆ | B |
| 15 μm | 35 μm | ○ | A | 1 μm | 5 μm | ☆ | B |
| 10 μm | 27 μm | ○ | A | 0.8 μm | 4 μm | ☆ | C |
| 8 μm | 25 μm | ☆ | A | | | | |

In Table 2, crosses, triangles, circles, and stars respectively denote the same results of evaluation as in Table 1, and letters A, B and C respectively represent the same degrees of image quality as in Table 1.

As table 2 indicates, rear smearing was reduced when the surface roughness was less than 45 μm Rz inclusive, almost none when it was less than 35 μm Rz inclusive, or none when it was less than 25 μm Rz inclusive. When the surface roughness was less than 5 μm, a satisfactory image was not obtained. Further, the smearing was reduced when the diameter of the fibers 26*a* was less than 20 μm inclusive, almost none when it was less than 15 μm inclusive, or none when it was less than 8 μm inclusive. In addition, when the fiber diameter was less than 1 μm, a satisfactory image was not obtained.

In light of the above, the member 26 is provided with a surface roughness ranging from 5 μm Rz to 45 μm Rz, preferably 5 μm Rz to 35 μm Rz or more preferably 5 μm Rz to 25 μm Rz, on its surface for wrapping the master 27. Also, the member 26 is provided with a fiber diameter of greater than 1 μm inclusive, but smaller than 20 μm inclusive, preferably greater than 1 μm inclusive, but smaller than 15 μm inclusive or more preferably greater than 1 μm inclusive, but smaller than 8 μm inclusive, as measured on the above surface.

In the above embodiment, the member 26 is implemented by an unwoven cloth. If desired, the unwoven cloth may be replaced with a mesh screen of Manila hemp, flax or similar natural fibers, Tetron (trade name), nylon (trade name) or similar synthetic resin fibers, or stainless steel, iron, copper, nickel, aluminum, titanium or similar metal fibers, an unwoven cloth of stainless steel, iron, copper, nickel, aluminum, titanium or similar metal fibers, a sheet formed by sintering Tetron (trade name), nylon (trade name) or similar synthetic resin fibers, a polyvinyl acetal- or polyvinyl alcohol-based porous elastic member having continuous bubbles, a porous elastic member which is a mixture of hard grain and rubber and has continuous bubbles, a porous elastic member formed by sintering the fine powder of polyethylene or similar synthetic resin or inorganic substance, a porous elastic member formed by liquid-sintering polyurethane or the like, or a porous elastic member made of porous rubber or the like.

Further, the above mesh screens, unwoven cloths, sintered sheets and various porous elastic members may each have a porous substrate provided with the fine powder of, e.g., metal or resin at least on the surface for wrapping the stencil by dispersion, melting, or adhesion. Then, the member 26 will have its surface roughness reduced.

Figure 19:
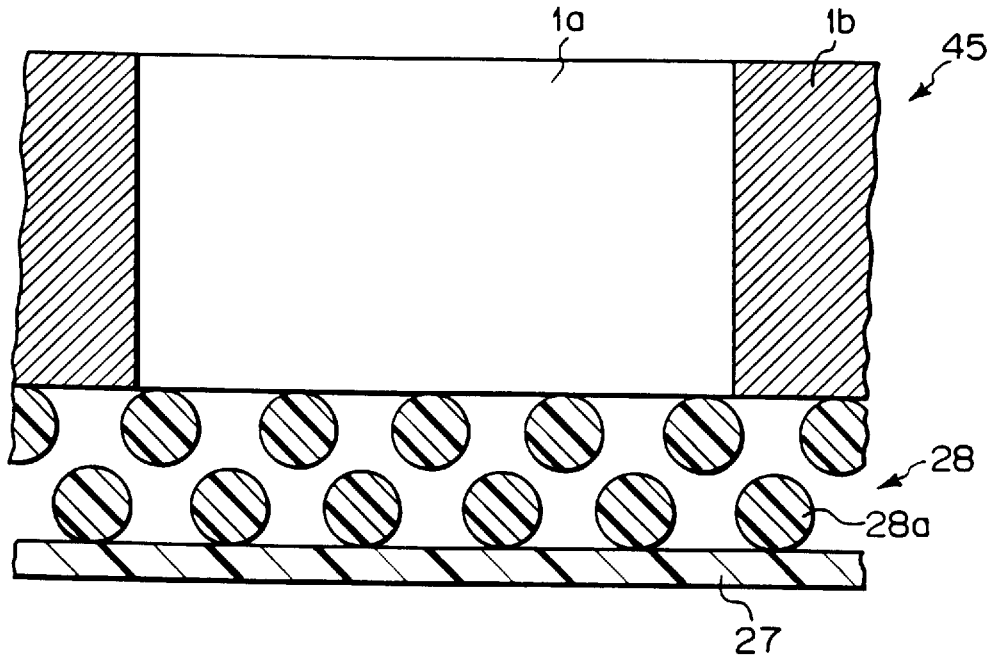
FIG. 19 is a fragmentary sectional side elevation of a drum and an ink holding member representative of an eighth embodiment.
Figure 20:
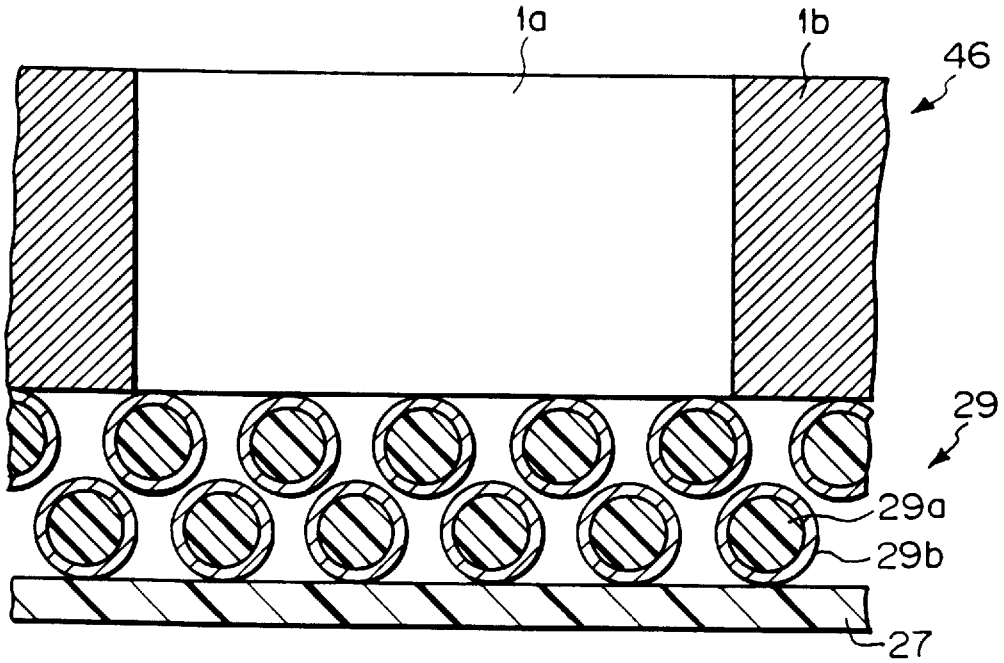
FIG. 20 is a fragmentary sectional side elevation of a drum and an ink holding member representative of a modification of the eighth embodiment.

FIG. 19 shows a drum 45 representative of an eighth embodiment of the present invention while FIG. 20 shows a drum 46 representative of its modification. The embodiment and its modification to be described are identical with the seventh embodiment except that the drums 45 and 46 are each substituted for the drum 43.

The drum 45 is mainly constituted by the porous support 1*b* and an ink holding member 28. The ink holding member 28 is a sintered sheet implemented by fibers 28*a* of stainless steel, iron, copper, nickel, titanium, aluminum or similar metal. On the other hand, the drum 46 is mainly constituted by the porous support 1*b* and an ink holding member 29. This member 29 is a sintered sheet consisting of Tetron (trade name), nylon (trade name) or similar synthetic resin fibers 29*a,* and stainless steel, iron, copper, nickel, titanium, aluminum or similar metal 29*b* coating the individual fiber 29*a.* Each member 28 or 29 is provided with a surface roughness ranging from 5 μm Rz to 45 μm Rz, preferably 5 μm Rz to 35 μm Rz or more preferably 5 μm Rz to 25 μm Rz, as measured on its surface for wrapping the master 27. Also, each member 28 or 29 is provided with a fiber diameter greater than 1 μm inclusive, but smaller than 20 μm inclusive, preferably greater than 1 μm inclusive, but smaller than 15 μm inclusive or more preferably greater than 1 μm inclusive, but smaller than 8 μm inclusive, as measured on the above surface. The members 28 and 29 are each produced by sintering an unwoven cloth of metal fibers 28*a* or an unwoven cloth having the synthetic resin fibers 29*a* coated with the metal 29*b*.

The above members 28 and 29 implemented by metals each has a high energy surface and wettability and enhances the adhesion of the ink thereto. Hence, the ink is prevented from being drawn out of the members 28 and 29 in an excessive amount, so that rear smearing is obviated.

The members 28 and 29 are more elastic than a porous substrate constituted by natural fibers or synthetic resin fibers. This is desirable from the following respect. Assume that the press roller or similar pressing member is pressed against the member 28 or 29 to cause it to discharge the ink, and then released therefrom. Then, the member 28 or 29 is elastically restored while sucking the ink thereinto. As a result, the excessive transfer of the ink to the paper which would bring about rear smearing is obviated. Further, because the members 28 and 29 are more strong than the porous substrate of natural fibers or synthetic resin fibers, they yield little even when used over a long period of time. Therefore, the members 28 and 29 are durable and feasible for mass printing.

In the above embodiment and its modification, the members 28 and 29 are each comprised of a sintered sheet of metal fibers 28*a* or a sintered sheet of synthetic resin fibers 29*a* coated with the metal 29*b*. However, use may be made of any other kind of ink holding member so long as it has a metallic surface and has passageways for the ink to pass, e.g., an unwoven cloth of metal fibers, an unwoven cloth of synthetic resin fibers whose surface is coated with metal, a mesh screen of metal fibers, or a porous member formed by sintering fine powder of metal. A sintered sheet is particularly desirable because it is greater in tensile strength than unwoven cloths and is lower in cost than mesh screens.

Figure 21:
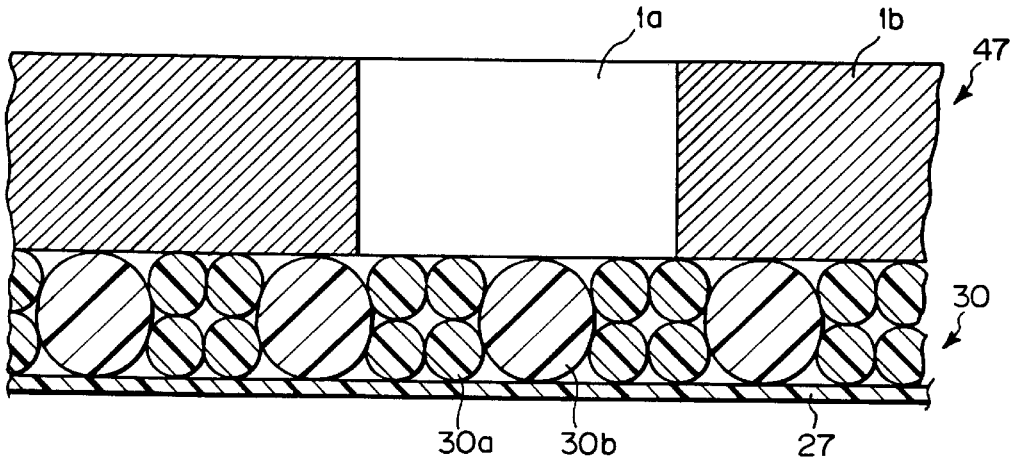
FIG. 21 is a fragmentary sectional side elevation of a drum and an ink holding member representative of a ninth embodiment.
Figure 22A:
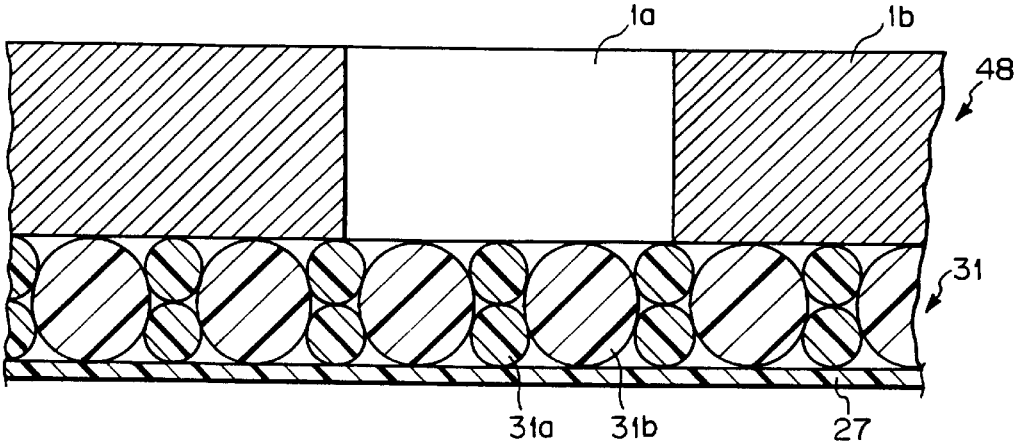
FIGS. 22A and 22B are fragmentary sectional side elevations each showing a drum and an ink holding member representative of a particular modification of the ninth embodiment.

FIG. 21 shows a drum 47 representative of a ninth embodiment while FIG. 22A shows a drum 48 representative of its modification. The embodiment and its modification to be described are identical with the seventh embodiment except that the drums 47 and 48 are each substituted for the drum 43.

The drum 47 is mainly constituted by the porous support 1*b* and an ink holding member 30 while the drum 48 is mainly constituted by the support 1*b* and an ink holding member 31.

The ink holding member 30 is an unwoven cloth made up of two different kinds of synthetic resin fibers 30*a* and 30*b* each having a particular diameter. The nearby fibers 30*b* sandwich two arrays of fibers 30*a*. Likewise, the member 31 is an unwoven cloth made up of two different kinds of synthetic resin fibers 31*a* and 31*b* each having a particular diameter, but the nearby fibers 31*b* sandwich a single array of fibers 31*a*. In this embodiment and its modification, the fibers 30*a* and 31*a* each has a diameter of 4 μm while the fibers 30*b* and 31*b* each has a diameter of 8 μm. The diameter and mixture ratio of the synthetic resin fibers are selected such that each member 30 or 31 can be provided with a surface roughness of 5 μm Rz to 45 μm Rz, preferably 5 μm Rz to 35 μm Rz or more preferably 5 μm Rz to 25 μm Rz, at its surface for wrapping the master 27. The synthetic resin fibers are selected such that their diameter is greater than 1 μm inclusive, but smaller than 20 μm inclusive, preferably greater than 1 μm inclusive, but smaller than 15 μm inclusive or more preferably greater than 1 μm inclusive, but smaller than 8 μm inclusive, as measured on the surface for wrapping the master 27. If desired, three or more different kinds of synthetic resin fibers may be combined.

Each member 30 or 31 having the above configuration has its bores between the thick fibers filled with the thin fibers. This successfully reduces the irregularity L (surface roughness Rz) of the drums 47 and 48. In addition, the thick fibers increase the tensile strength of the members 30 and 31.

The ink holding members or unwoven cloths 30 and 31 consisting of the synthetic resin fibers 30*a* and 30*b* and synthetic resin fibers 31*a* and 31*b* may each be replaced with any one of the other materials mentioned in relation to the eighth embodiment, e.g., a sintered sheet of metal fibers, a sintered sheet of synthetic resin fibers whose surface is coated with metal, an unwoven cloth or mesh screen of metal fibers, an unwoven cloth or mesh screen of synthetic fibers whose surface is coated with metal, or such a sintered sheet, unwoven cloth or mesh screen in which fine powder of metal or resin is dispersed, melted or adhered between the synthetic resin fibers and the metal fibers. These substitutes are also constituted by two or more different kinds of fibers each having a particular diameter.

Figure 22B:
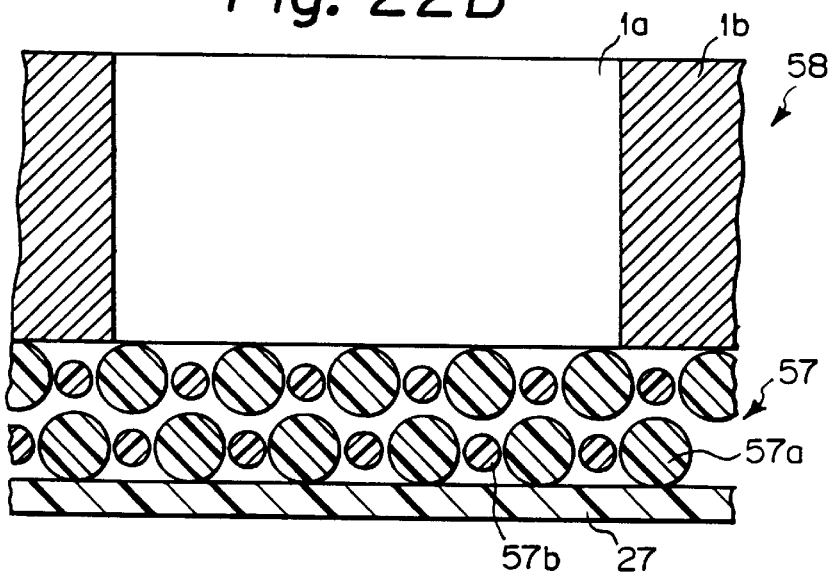

FIG. 22B shows another modification of the ninth embodiment. As shown, a drum 58 has an ink holding member 57 which is an unwoven cloth consisting of thick synthetic resin fibers 57*a* and thin synthetic resin fibers 57*b* arranged in a zig-zag configuration, and the porous support 1*b*.

Figure 23:
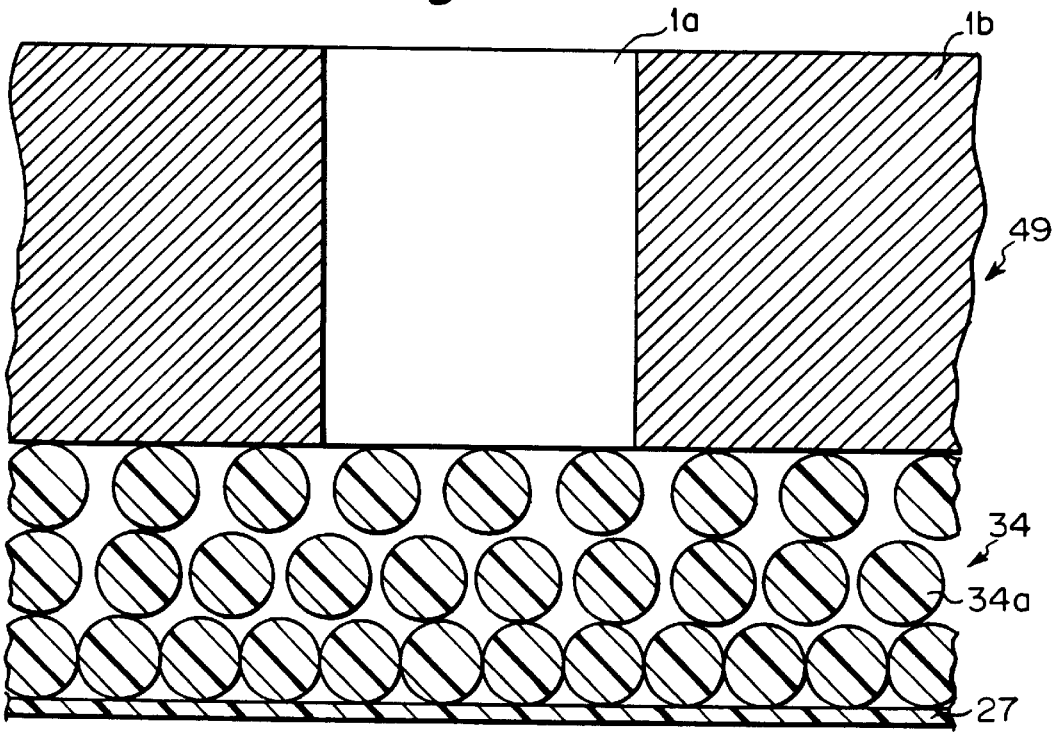
FIG. 23 is a fragmentary sectional side elevation of a drum and an ink holding member representative of a tenth embodiment.
Figure 24:
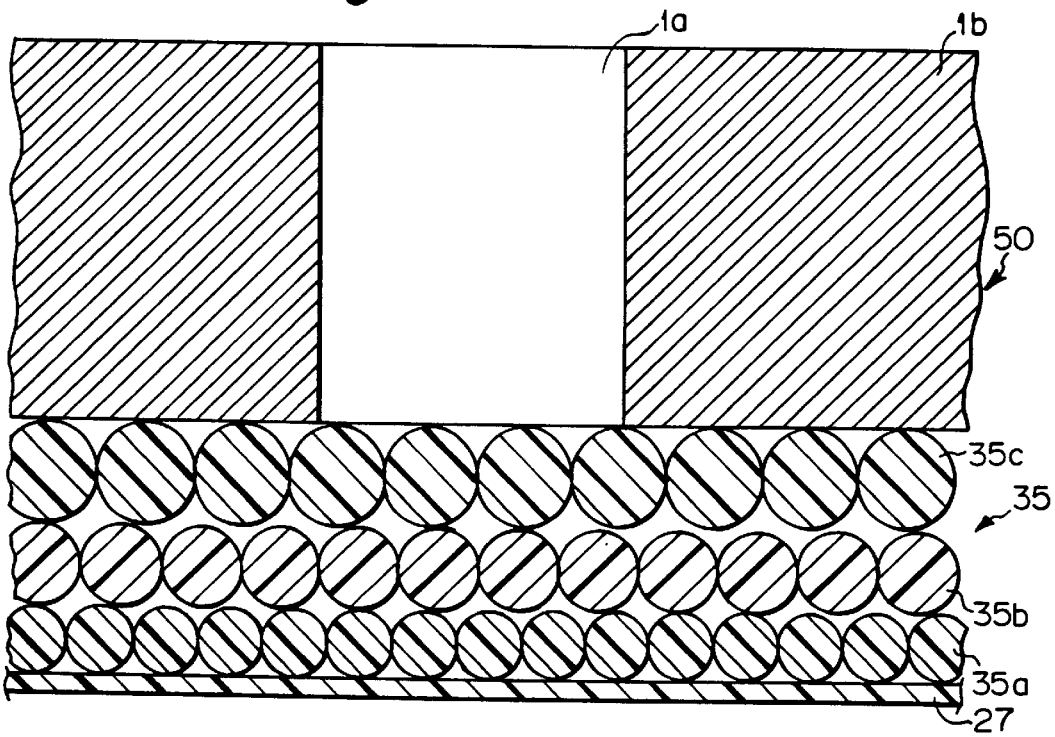
FIG. 24 is a fragmentary sectional side elevation of a drum and an ink holding member representative of an eleventh embodiment.

FIGS. 23 and 24 respectively show a drum 49 and a drum 50 representative of a tenth embodiment and an eleventh embodiment of the present invention. The embodiments to be described are identical with the seventh embodiment except that the drums 49 and 50 are each substituted for the drum 43.

The drum 49 is mainly constituted by the porous support 1*b* and an ink holding member 34. The ink holding member 34 is an unwoven cloth implemented by identical synthetic resin fibers 34*a* stacked in layers. It is noteworthy that the density of the fibers 34*a* sequentially decreases from the master or thermoplastic resin film 27 side toward the support 1*b* side.

The drum 50 is mainly constituted by the porous support 1*b* and an ink holding member 35. The ink holding member 35 is an unwoven cloth consisting of synthetic resin fibers 35*a*, 35*b* and 35*c* arranged in layers and each having a particular diameter. The fibers 35*a* of the outermost layer closest to the master 27 has the smallest diameter. The fiber diameter sequentially increases from the outermost layer to the innermost layer which is constituted by the fibers 35*c*.

In each of the members 34 and 35, the bores sequentially decrease in size toward the surface where the master 27 is wrapped.

The above members 34 and 35 each has a surface roughness of 5 μm Rz to 45 μm Rz, preferably 5 μm Rz to 35 μm Rz or more preferably 5 μm Rz to 25 μm Rz, as measured on the surface for wrapping the master 27. The synthetic resin fibers 34*a* and 35*a* are selected such that their diameter is greater than 1 μm inclusive, but smaller than 20 μm inclusive, preferably greater than 1 μm inclusive, but smaller than 15 μm inclusive or more preferably greater than 1 μm inclusive, but smaller than 8 μm inclusive, as measured at least on the surface for wrapping the master 27.

While the fibers 34*a* and fibers 35*a*–35*c* are each arranged in three layers, they may be laminated in any desired number of layers if it is two or more. The layers of the fibers 34*a* and 35*a*–35*c* may each be implemented as a unitary structure or a laminate structure (two or more layers). With this kind of scheme, it is possible to prepare a plurality of ink holding members each having bores of particular size, and laminate them such that the bores sequentially decrease in size toward the outer periphery of the drum.

In each of the ink holding members 34 and 35, the ink is easily fed and spread in the initial part of the passageways due to the great bores. In the last part of the passageways, the irregularity L of the members 34 and 35 is small due to the small bores.

In the above embodiments, the ink holding members 34 and 35 may each be replaced with any one of the substitutes mentioned in relation to the eighth embodiment, e.g., a sintered sheet of metal fibers, a sintered sheet of synthetic resin fibers whose surface is coated with metal, an unwoven cloth or a mesh screen of metal fibers, an unwoven cloth or a mesh screen of synthetic resin fibers whose surface is coated with metal, such a sintered sheet, unwoven cloth or mesh screen in which fine powder of metal or resin is dispersed, melted or adhered between the synthetic resin fibers and the metal fibers, or a porous member produced by sintering fine powder of metal. The crux is that the surface of the substrate is formed by metal. Even these substitutes are each configured such that the bores sequentially decrease in size toward the surface for wrapping the master. Further, use may be made of a porous elastic support having continuous bubbles, or a porous elastic support formed by liquid sintering, as mentioned in relation to the first embodiment.

Figure 25:
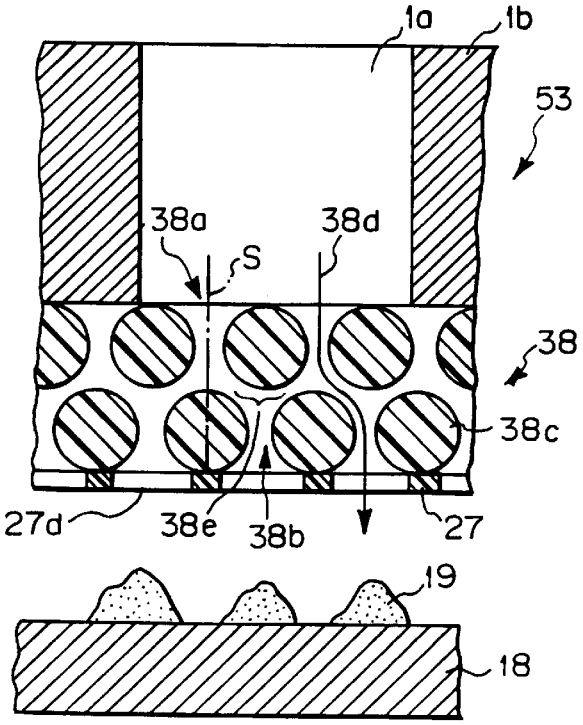
FIG. 25 is a fragmentary sectional side elevation of a drum and an ink holding member representative of a twelfth embodiment.

FIG. 25 shows a drum 53 representative of a twelfth embodiment. This embodiment is identical with the seventh embodiment except that the drum 53 is substituted for the drum 43. As shown, the drum 53 is mainly constituted by the porous support 1*b* and an ink holding member 38 which is an unwoven cloth mainly constituted by fiber members 38*c*. Ink passageways 38*d* are formed in the member 38 such that the ink flown into the member 38 via an inlet pore 38*a* is deflected at least once from a vertical S extending to the outer periphery of the drum 53, and then flows out via an outlet pore 38*b*. In this configuration, the ink flown into the member 38 via the pore 38*a* is substantially entirely blocked by the fiber member 38*c* existing on the vertical S and prevented from flowing down along the vertical S thereby. Stated another way, substantially the entire ink entered the pore 38*a* is caused to flow outward away from the vertical S due to the fiber member 38*c*, and then flow downward toward the pore 38*b*.

When the paper 18 is separated from the surface of the master 27, the adhering force of the ink 19 acts between the ink 19 and the ceiling portion 38*e* of the pore 38*b*. As a result, the amount in which the ink 19 is drawn out of the member 38 is reduced. In FIG. 25, the master 27 is shown as having the perforations 27*d* formed therein.

Figure 26:
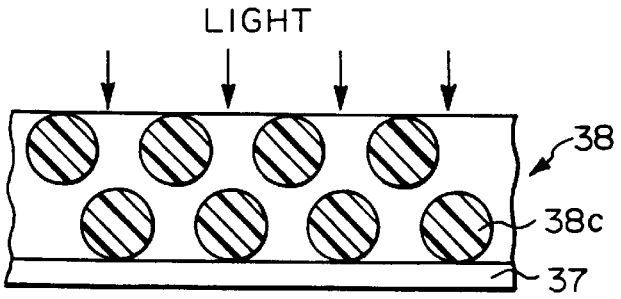
FIG. 26 is a fragmentary sectional side elevation for describing the ink holding member of the twelfth embodiment.

A specific method for determining whether or not the above ink passageways 38*d* have been successfully formed in the member 38 is as follows. As shown in FIG. 26, the paper 37 different in color from the member 38 is adhered to the rear of the member 38. In this condition, the member 38 and paper 37 are observed through a microscope with 50 magnifications while being illuminated from the member 38 side. If the paper 37 is not visible through between the fiber members 38*c*, it can be determined that the desired passageways 38*d* have been formed. Alternatively, use may be made of the actinometer scheme described with reference to FIG. 15.

Figure 27:
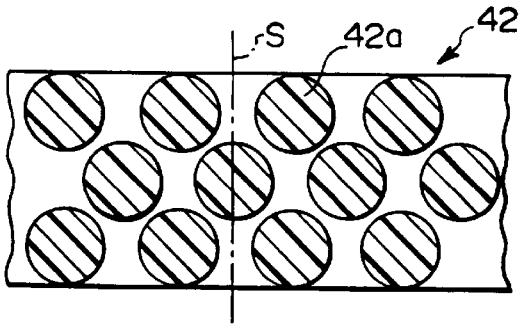
FIG. 27 is a fragmentary sectional side elevation of an ink holding member representative of a modification of the twelfth embodiment.

As shown in FIG. 27, as a modification of this embodiment, use may be made of an ink holding member 42 consisting of fiber members 42*a* similar to the fiber members 38*c* and laminated in three or more layers.

In the illustrative embodiment and its modification, the members 38 and 42 each has a surface roughness of 5 μm Rz to 45 μm Rz, preferably 5 μm Rz to 35 μm Rz or more preferably 5 μm Rz to 25 μm Rz, as measured on its surface for wrapping the master or thermoplastic resin film 27. Also, the fiber members 38*c* and 42*a* have a diameter of greater than 1 μm inclusive, but smaller than 20 μm inclusive, preferably greater than 1 μm inclusive, but smaller than 15 μm inclusive or more preferably greater than 1 μm inclusive, but smaller than 8 μm inclusive, as measured on the surface for wrapping the master 27. Further, each of the fiber members 38*c* and 42*a* may be implemented as two or more different kinds of fiber members each having a particular diameter.

Further, as in the tenth and eleventh embodiments, the density of the members 38 and 42 or the diameter of the fibers 38*c* and 42*a* may be changed such that the bores sequentially decrease in size toward the surface for wrapping the master 27. The members 38 and 42 may each be replaced with a porous member consisting of metal fibers or fibers coated with metal, a porous member formed by sintering fine powder of metal, or similar porous member at least the surface of which is formed of metal. In addition, for the porous member, use may be made of a porous elastic member having continuous bubbles, or a porous elastic member formed by liquid sintering, as mentioned in relation to the first embodiment.

Figure 28:
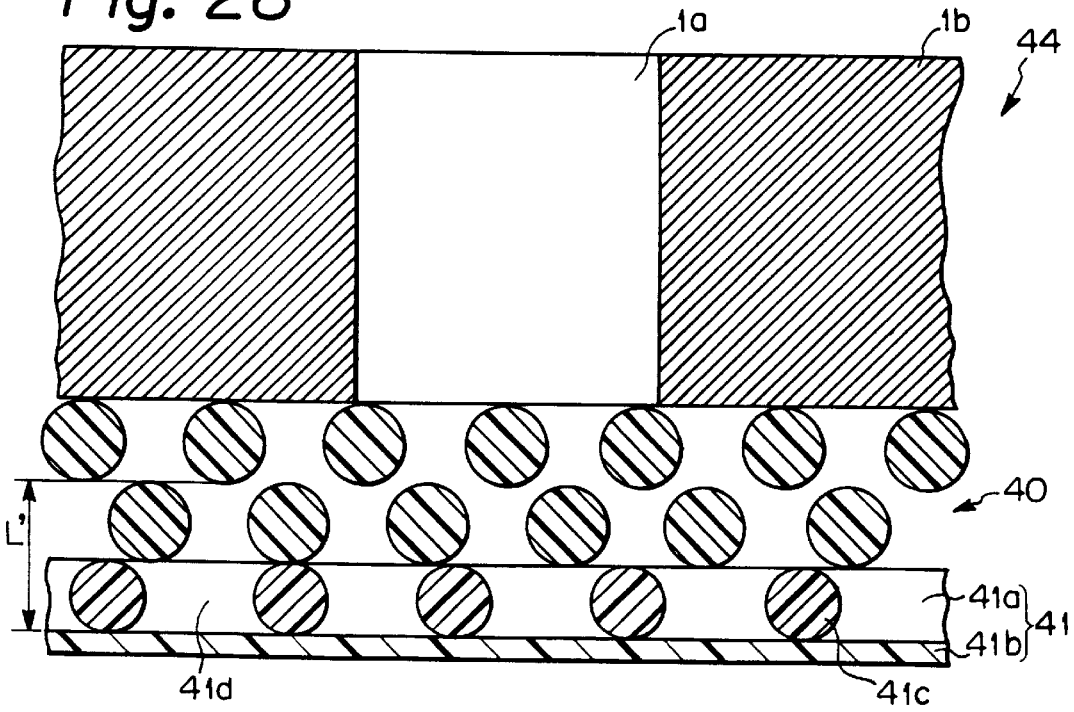
FIG. 28 is a fragmentary sectional side elevation of a drum and an ink holding means representative of a thirteenth embodiment.

FIG. 28 shows a drum 44 and a stencil or master 41 representative of a thirteenth embodiment of the present invention. The stencil 41 is made up of a porous substrate 41*a* and a thermoplastic resin film 41*b* adhered or otherwise joined with each other. This embodiment is identical with the seventh embodiment except that the stencil 41 and drum 44 are substituted for the stencil 27 and drum 43, respectively. The drum 44 is mainly constituted by the porous support 1*b* and an ink holding member 40. The ink holding member 40, like the member 26, is implemented by an unwoven cloth, mesh screen, sintered sheet, porous elastic member, or the like.

The substrate 41*a* of the stencil 41 is a unwoven cloth of Tetron (trade name), nylon (trade name), rayon (trade name), vinylon (trade name), polyester or similar synthetic resin fibers 41*c*. The film 41*b* is made of polyester or similar thermoplastic resin. If desired, the substrate 41*a* may be implemented by a porous thin sheet of kozo, mitsumata, Manila hemp, flax or similar natural fibers, an unwoven cloth of natural fibers and synthetic fibers mixed together, a mesh screen of Tetron (trade name), nylon (trade name) or similar synthetic resin fibers, or a sintered sheet of synthetic fibers and metal fibers.

The seven embodiment described earlier indicates that the surface roughness of the ink holding member is related to the prevention of rear smearing. Assume that the substrate 41*a* intervenes between the ink holding member 40 and the film 41*b*, that many of bores 41*d* existing in the substrate 41*a* allow the ink to flow straight without being deflected, and that the bores 41*d* are greater in size than the perforations 8*d* shown in FIG. 4, formed in the film 41*b*. Then, the surface roughness of the member 40 may be considered as being equal to a distance L' between the inner surface of the film 41*b* and the recesses of the outer surface of the member 40, as shown in FIG. 28. Therefore, the distance L' should be greater than 5 μm inclusive, but smaller than 45 μm inclusive, in order to obviate rear smearing.

In this embodiment, the substrate 41*a* intervenes between the film 41*b* and the ink holding member 40. Hence, to eliminate rear smearing, it is necessary that the sum of the thickness of the substrate 41*a* and the surface roughness of the member 40 be greater than 5 μm inclusive, but smaller than 45 μm inclusive. For example, if the substrate 41*a* is 20 μm thick, then the surface roughness of the member 40 should be smaller than 25 μm inclusive. It is to be noted that the sum of the thickness of the substrate 41*a* and the surface roughness of the member 40 should preferably be greater than 5 μm inclusive, but smaller than 35 μm inclusive, more preferably greater than 5 μm inclusive, but smaller than 25 μm inclusive.

The substrate 41*a* of this embodiment and the substrate 8*c* of the first embodiment are different in the following respect. The substrate 41*a* has many bores 41*d* that allow the ink to flow straight without being deflected, and the bores 41*d* are greater in size than the perforations 8*d* formed in the film 41*b*. Hence, the ink flows in the substrate 41*a* easily and runs out at the surface of the member 40. By contrast, the substrate 8*c* has many passageways that deflect the ink, causing the ink to run out at the surface of the substrate 8*c*. Hence, in the first embodiment the surface roughness of the substrate 8*c* is related to rear smearing, while in this embodiment the sum of the thickness of the substrate 41*a* and the surface roughness of the member 40 is related to rear smearing.

In this embodiment, the ink holding member 40 may be replaced with an ink holding member which is an unwoven cloth of two or more different kinds of fibers each having a particular diameter. The density of the member 40 or the diameter of the fibers constituting the member 40 may be changed such that the bores of the member 40 sequentially decrease in size toward the outer surface for wrapping the stencil 41. Also, the member 40 may be implemented by an unwoven cloth, sintered sheet or mesh screen of metal fibers or of fibers coated with metal, a porous member formed by sintering fine powder of metal, or similar member at least the surface of which is formed of metal. Further, the member 40 may be provided with passageways similar to the passageways formed in the ink holding member 38 of the twelfth embodiment or the ink holding member 42 of its modification. In addition, for the member 40, use may be made of a porous elastic member having continuous bubbles or formed by liquid sintering, as mentioned in relation to the first embodiment.

Figure 29:
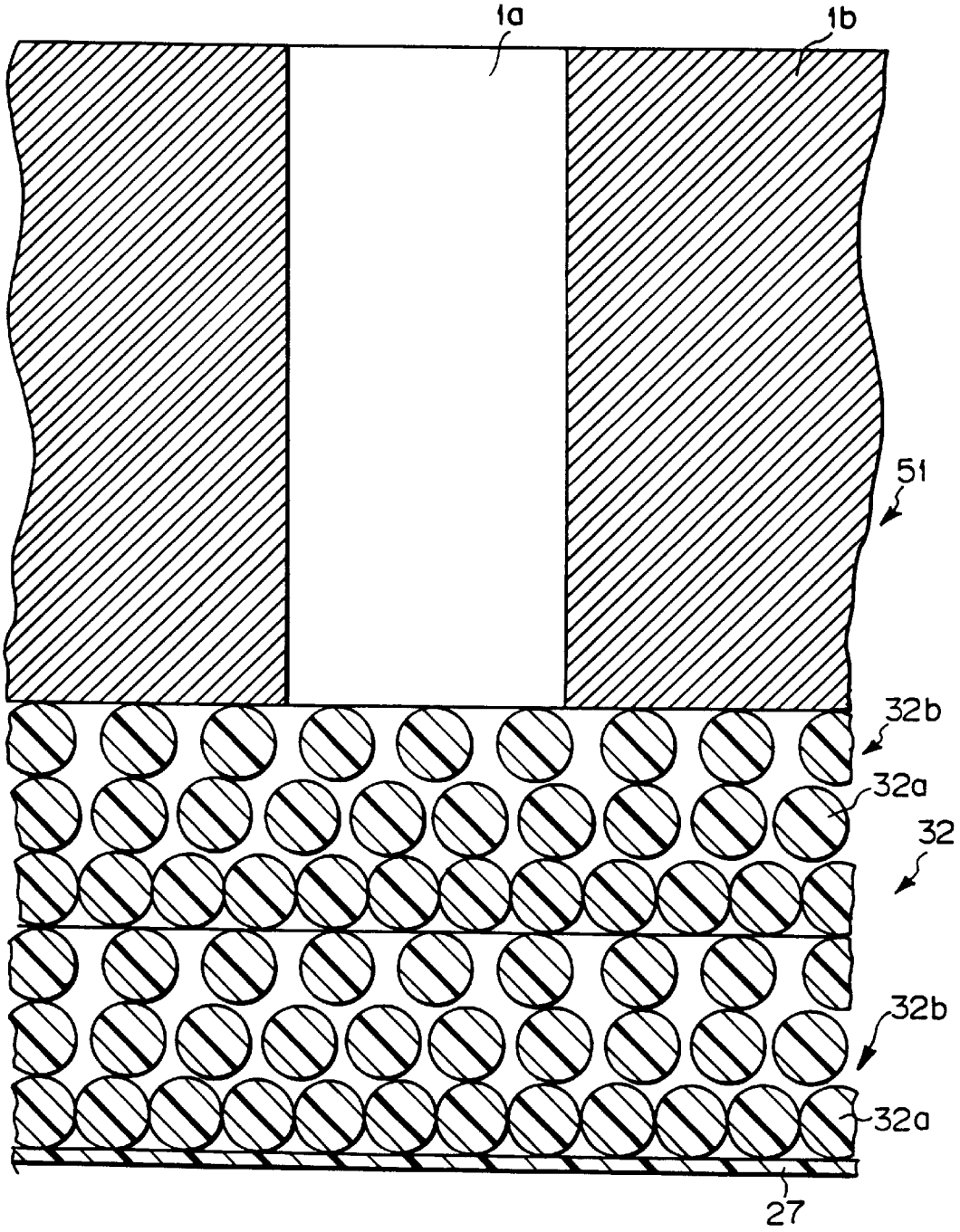
FIG. 29 is a fragmentary sectional side elevation of a drum and an ink holding means representative of a fourteenth embodiment.
Figure 30:
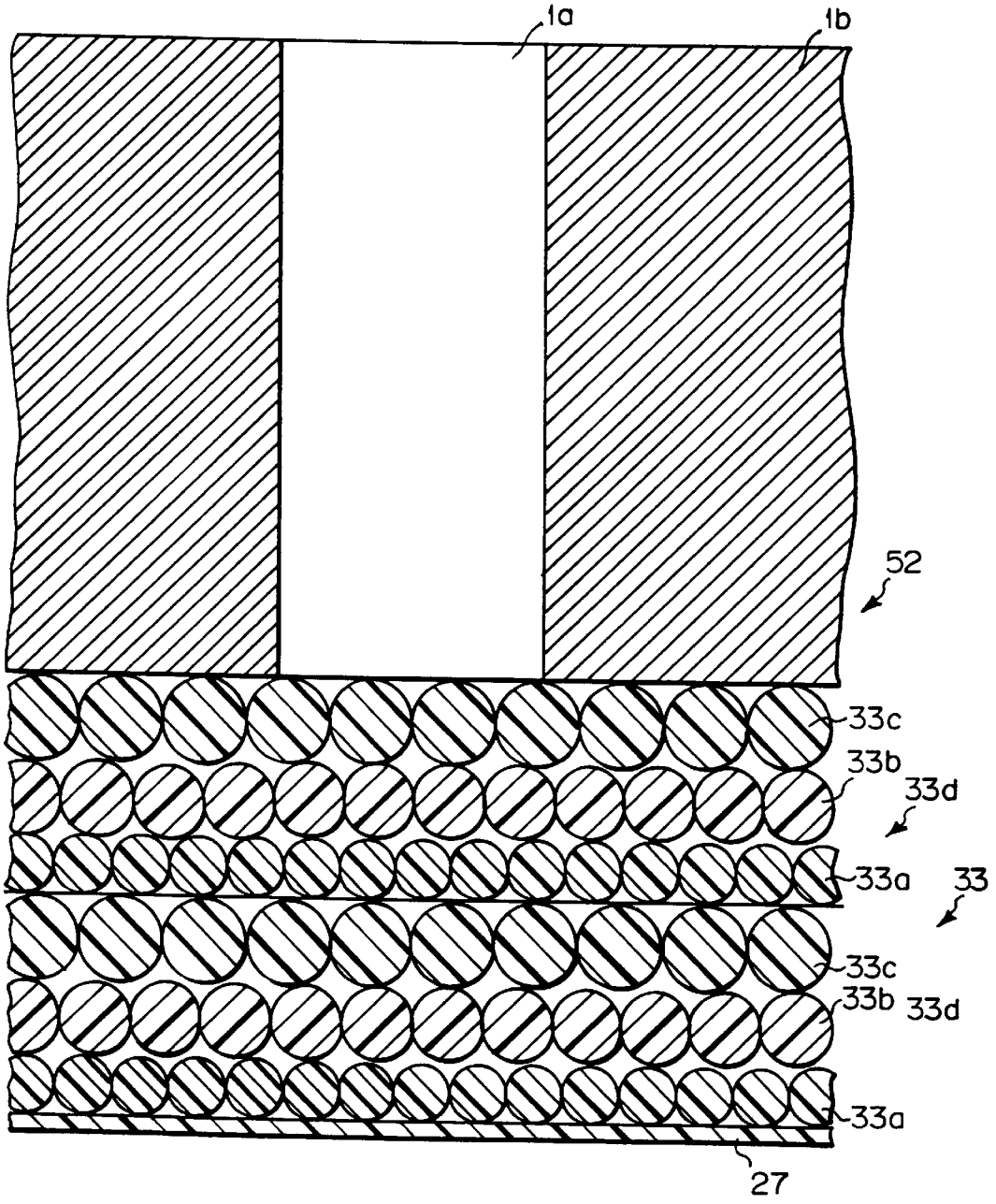
FIG. 30 is a fragmentary sectional side elevation of a drum and an ink holding means representative of a fifteenth embodiment.

FIGS. 29 and 30 respectively show drums 51 and 52 representative of a fourteenth embodiment and a fifteenth embodiment. These embodiments are identical with the seventh embodiment except that the drums 51 and 52 are each substituted for the drum 43.

As shown in FIG. 29, the drum 51 is mainly constituted by the porous support 1*b* and an ink holding member 32. The ink holding member 32 is implemented as a laminate of two ink holding members or layers 32*b*. Each ink holding member 32*b* is an unwoven cloth consisting of a plurality of layers of identical synthetic resin fibers 32*a*. The ink holding members 32*b* are each configured such that the density of the fibers 32*a* sequentially decreases from the stencil 27 side toward the support 1*b* side.

As shown in FIG. 30, the drum 52 is mainly constituted by the porous support 1*b* and an ink holding member 33. The ink holding member 33 is also implemented as a laminate of two ink holding members or layers 33*d*. Each ink holding member 33*d* is an unwoven cloth consisting of consecutive layers of synthetic resin fibers 33*a*, 33*b* and 33*c* each having a particular diameter. In each member 33*d*, the fibers 33*a* in the layer adjoining the stencil 27 have the smallest diameter; the diameter sequentially increases toward the fibers 33*c* which constitute the innermost layer.

In both of the above layers 32*b* and 33*d*, the bores sequentially decrease in size toward the surface for wrapping the stencil 27. In the fourteen and fifteenth embodiments, the fibers 32*a* and 33*a* each has a diameter of greater than 1 μm inclusive, but smaller than 20 μm inclusive, preferably greater than 1 μm, but smaller than 15 μm inclusive or more preferably greater than 1 μm, but smaller than 8 μm inclusive, as measured at least on the surface for wrapping the stencil 27.

While the ink holding layers 32*b* and 33*d* are each shown as having the fibers 32*a* or the fibers 33*a*–33*c* arranged in three layers, the fibers may be arranged in any desired number of layers so long as it is two or more. Also, the number of ink holding layers 32*b* or 33*d* is not limited to two, but may be two or more than three.

The ink holding members 32 and 33 may each be configured such that the ink entered via an inlet bore is deflected from a vertical extending to the outer periphery of the drum 51 or 52 at least once, and then caused to flow out via an outlet bore, as in the twelfth embodiment.

By using the ink holding member 32 or 33, it is possible to promote the feed and spread of the ink in the initial stage due to the great bores, and reduce the irregularity L in the final stage due to the small bores.

In the above embodiments, the ink holding members 32 and 33 may each be replaced with any one of the substitutes mentioned in relation to the eighth embodiment, e.g., a sintered sheet of metal fibers, a sintered sheet of synthetic resin fibers whose surface is coated with metal, an unwoven cloth or a mesh screen of metal fibers, an unwoven cloth or a mesh screen of synthetic resin fibers whose surface is coated with metal, such a sintered sheet, unwoven cloth or mesh screen in which fine powder of metal or resin is dispersed, melted or adhered between the synthetic resin fibers and the metal fibers, or a porous member produced by sintering fine powder of metal. The crux is that the surface of the substrate is formed by metal. Further, use may be made of a porous elastic support having continuous bubbles, or a porous elastic support formed by liquid sintering, as mentioned in relation to the first embodiment.

In the seventh to fifteenth embodiments, the drums are each comprised of the porous support 1*b* and ink holding member. The support 1*b* is omissible, if desired. Then, each drum will be implemented only by a hollow cylindrical ink holding member, as taught in, e.g., Japanese Patent Laid-Open Publication No. 1-204781 or 59-218889 mentioned previously. In such a case, the member is referred to as a drum when provided with a cylindrical configuration and disposed in a printer, or referred to as an ink holding member when implemented as a sheet.

In each of the seventh to fifteenth embodiments, an ink holding layer in the form of a mesh screen or unwoven cloth may be interposed between the support 1*b* and the ink holding member.

In the embodiments shown and described, the stencil consisting only of the thermoplastic resin film refers even to a thermoplastic resin film containing a small amount of antistatic agent, and a thermoplastic resin film provided with one or more thin film layers on at least one of opposite sides thereof. Further, in the stencil consisting of the porous support and the thermoplastic resin film, the film may contain a small amount of antistatic agent and may be provided with one or more thin film layers on the outer surface thereof.

In summary, it will be seen that the present invention provides a drum and a stencil for a stencil printer and having various unprecedented advantages, as enumerated below.

(1) The stencil is made up of a porous substrate and a thermoplastic resin film. The side of the substrate contacting the film has a surface roughness of 5 μm Rz to 45 μm Rz, preferably 5 μm Rz to 35 μm Rz or more preferably 5 μm Rz to 25 μm Rz. In this condition, bores existing in the substrate above perforations formed in the film by a thermal head and filled with ink are reduced in size, so that the amount of ink to be drawn out from the substrate is reduced. This successfully allows the ink to be drawn out via the perforations of the film in an adequate amount and thereby reduces the period of time necessary for the ink to infiltrate into a paper and dry. As a result, papers are free from rear smearing, and desirable images are insured.

(2) The substrate consists of two or more different kinds of fibers each having a particular diameter. In this configuration, thin fibers fill the gaps between thick fibers so as to reduce the surface roughness of the substrate. This allows the ink to be drawn out from the perforations of the film in an adequate amount during the course of printing. As a result, papers are free from rear smearing, and desirable images are insured. In addition, the thick fibers increase the strength of the stencil and thereby prevent the stencil from being torn off or stretched.

(3) The bores in the substrate sequentially decrease in size from the side of the substrate not contacting the film toward the side contacting it. Hence, the ink is easily fed and spread in the initial part of ink passageways, and then drawn out in an adequate amount in the final part of the same. As a result, papers are free from rear smearing, and desirable images are insured. In addition, the substrate plays the role of an ink holding layer provided on the outer periphery of a drum. This eliminates the need for the ink holding layer and thereby reduces the cost.

(4) The substrate has at least its surface implemented by metal. This enhances the adhesion acting between such a high energy surface and the ink and thereby prevents the ink from being drawn out from the substrate in an excessive amount. Because the substrate is highly elastic, it discharges the ink when pressed by a pressing member and then sucks it when the pressing member is released from the substrate. Hence, the transfer of an excess ink to a paper is obviated. This also eliminates rear smearing and insures desirable images. Moreover, because the substrate is strong, it does not yield even after a long time of operation and is free from corrosion due to the ink. This kind of stencil is durable and feasible for mass printing.

(5) Ink passageways are formed in the substrate such that the ink entered the substrate via an inlet pore is deflected at least once from a vertical extending to the surface of the film, and then caused to flow out via an outlet bore. This reduces the amount of ink to be drawn out from the substrate via the perforations of the film, reduces the infiltrating and drying time of the ink transferred to a paper, and thereby reduces rear smearing.

(6) An ink holding member is provided on the outer periphery of the drum. The ink holding member has a surface roughness of 5 μm Rz to 45 μm Rz, preferably 5 μm Rz to 35 μm Rz or more preferably 5 μm Rz to 25 μm Rz, as measured on the side contacting the stencil which is implemented only by the thermoplastic resin film. In this condition, bores existing in the ink holding member above the perforations of the film and filled with ink are reduced in size, so that the amount of ink to be drawn out from the member via the perforations of the film is reduced. This successfully allows the ink to be drawn out via the perforations of the film in an adequate amount and thereby reduces the infiltrating and drying time of the ink. As a result, when the above kind of stencil is used, papers are free from rear smearing, and desirable images are insured.

(7) The sum of the surface roughness of the ink holding member, as measured at the side contacting the substrate of the stencil, and the thickness of the substrate is selected to be 5 μm Rz to 45 μm Rz, preferably 5 μm Rz to 35 μm Rz or more preferably 5 μm Rz to 25 μm Rz. This successfully allows the ink to be drawn out from the ink holding member and substrate via the perforations of the film in an adequate amount and thereby reduces the infiltrating and drying time of the ink. As a result, when the stencil having the substrate is used, papers are free from rear smearing, and desirable images are insured.

(8) The ink holding member of the drum consists of two or more different kinds of fibers each having a particular diameter. In this condition, thin fibers fill the gaps between thick fibers and thereby reduce the surface roughness of the ink holding member. This allows the ink to be drawn out from the ink holding member or the ink holding member and substrate via the perforations of the film in an adequate amount during the course of printing. As a result, the infiltrating and drying time of the ink is reduced. Further, when use is made of the stencil implemented only by the thermoplastic resin film or the stencil having the substrate, papers are free from rear smearing, and desirable images are insured. In addition, the mixture of thick fibers and thin fibers enhances the durability of the drum without increasing the cost.

(9) Bores existing in the ink holding member sequentially decrease in size toward the outer surface of the member.

Hence, the ink is easily fed and spread in the initial part of ink passageways, and then drawn out in an adequate amount in the final part of the same. This reduces the infiltrating and drying time of the ink and thereby obviates rear smearing when use is made of the stencil implemented only by the thermoplastic resin film or the stencil having the substrate, while insuring desirable images.

(10) The ink holding member has at least its surface implemented by metal. This enhances the adhesion acting between such a high energy surface and the ink and thereby prevents the ink from being drawn out from the ink holding member in an excessive amount. Because the ink holding member is highly elastic, it discharges the ink when pressed by a pressing member and then sucks it when the pressing member is released from the member. Hence, the transfer of excess ink to a paper is obviated. This also eliminates rear smearing and insures desirable images when use is made of the stencil implemented only by the thermoplastic resin film or the stencil having the substrate. Moreover, because the ink holding member is strong, it does not yield even after a long time of operation and is free from corrosion due to the ink. This kind of member implements a drum which is durable and feasible for mass printing.

(11) Ink passageways are formed in the ink holding member such that the ink entered the member via an inlet pore is deflected at least once from a vertical extending to the outer periphery of the drum, and then caused to flow out via an outlet pore. This reduces the amount of ink to be drawn out from the ink holding member, reduces the infiltrating and drying time of the ink, and thereby reduces rear smearing.

(12) The surface roughness of the ink holding member constituting the outer periphery of the drum is selected to be 5 $\mu$m Rz to 45 $\mu$m Rz, preferably 5 $\mu$m Rz to 35 $\mu$m Rz or more preferably 5 $\mu$m Rz to 25 $\mu$m Rz. This reduces the size of the bores of the ink holding member in which the ink exists at the outer periphery side of the drum. This reduces the amount of ink to be drawn out from the ink holding member, reduces the infiltrating and drying time of the ink, and thereby reduces rear smearing while insuring desirable images.

(13) The ink holding member constituting the outer periphery of the drum consists of two or more different kinds of fibers each having a particular diameter. In this condition, thin fibers fill the gaps between thick fibers and thereby reduce the surface roughness of the ink holding member. This allows the ink to be drawn out from the ink holding member in an adequate amount during the course of printing. As a result, the infiltrating and drying time of the ink is reduced, so that rear smearing is reduced while desirable images are insured. In addition, the mixture of thick fibers and thin fibers enhances the durability of the ink holding member without increasing the cost.

(14) The ink holding member constituting the outer periphery of the drum has bores thereinside which sequentially decrease in size toward the outer surface. Hence, the ink is easily fed and spread in the initial part of ink passageways, and then drawn out in an adequate amount in the final part of the same. This reduces the infiltrating and drying time of the ink and thereby obviates rear smearing while insuring desirable images.

(15) The ink holding member constituting the outer periphery of the drum has at least its surface implemented by metal. This enhances the adhesion acting between such a high energy surface and the ink and thereby prevents the ink from being drawn out from the ink holding member in an excessive amount. Because the ink holding member is highly elastic, it discharges the ink when pressed by a pressing member and then sucks it when the pressing member is released from the member. Hence, the transfer of excess ink to a paper is obviated. This also eliminates rear smearing and insures desirable images. Moreover, because the ink holding member is strong, it does not yield even after a long time of operation and is free from corrosion due to the ink. This kind of member is durable and feasible for mass printing.

(16) Ink passageways are formed in the ink holding member, which constitutes the outer periphery of the drum, such that the ink entered the member via an inlet pore is deflected at least once from a vertical extending to the surface of the member having an outlet pore, and then caused to flow out via the outlet pore. This reduces the amount of ink to be drawn out from the ink holding member, reduces the infiltrating and drying time of the ink, and thereby reduces rear smearing.

(17) The substrate of the stencil has a fiber diameter of greater than 1 $\mu$m inclusive, but smaller than 20 $\mu$m inclusive, preferably greater than 1 $\mu$m inclusive, but smaller than 15 $\mu$m inclusive or more preferably greater than 1 $\mu$m inclusive, but smaller than 8 $\mu$m inclusive, as measured on the side contacting the film. In this condition, bores existing in the substrate above the perforations of the film and filled with the ink are reduced in size, so that the amount of ink to be drawn out from the substrate via the perforations is reduced. This successfully allows the ink to be drawn out from the substrate via the perforations of the film in an adequate amount and thereby reduces the infiltrating and drying time of the ink. As a result, papers are free from rear smearing, and desirable images are insured.

(18) The substrate consists of two or more different kinds of fibers each having a particular diameter. In this configuration, thin fibers fill the gaps between thick fibers so as to reduce the surface roughness of the substrate. This allows the ink to be drawn out from the substrate via the perforations of the film in an adequate amount during the course of printing. As a result, papers are free from rear smearing, and desirable images are insured.

(19) The bores in the substrate sequentially decrease in size from the side of the substrate not contacting the film toward the side contacting it. Hence, the ink is easily fed and spread in the initial part of ink passageways, and then drawn out in an adequate amount in the final part of the same. As a result, papers are free from rear smearing, and desirable images are insured. In addition, the substrate plays the role of an ink holding layer provided on the outer periphery of a drum. This eliminates the need for the ink holding layer and thereby reduces the cost.

(20) The substrate has at least its surface implemented by metal. This enhances the adhesion acting between such a high energy surface and the ink and thereby prevents the ink from being drawn out from the substrate in an excessive amount. Because the substrate is highly elastic, it discharges the ink when pressed by a pressing member and then sucks it when the pressing member is released from the substrate. Hence, the transfer of excess ink to a paper is obviated. This also eliminates rear smearing and insures desirable images. Moreover, because the substrate is strong, it does not yield even after a long time of operation and is free from corrosion due to the ink. This kind of stencil is durable and feasible for mass printing.

(21) Ink passageways are formed in the substrate such that the ink entered the substrate via an inlet pore is deflected at least once from a vertical extending to the surface of the film, and then caused to flow out via an outlet bore. This reduces the amount of ink to be drawn out from the substrate via the perforations of the film, reduces the infiltrating and drying time of the ink, and thereby reduces rear smearing.

(22) The ink holding member constituting the outer periphery of the drum has a fiber diameter of greater than 1 μm inclusive, but smaller than 20 μm inclusive, preferably greater than 1 μm inclusive, but smaller than 15 μm inclusive or more preferably greater than 1 μm inclusive, but smaller than 8 μm inclusive, as measured on the side contacting the stencil implemented only by the film. In this condition, bores existing in the ink holding member above the perforations of the film and filled with the ink are reduced in size, so that the amount of ink to be drawn out from the member via the perforations is reduced. This successfully allows the ink to be drawn out from the ink holding member via the perforations of the film in an adequate amount and thereby reduces the infiltrating and drying time of the ink. As a result, when use is made of the stencil implemented only by the film, papers are free from rear smearing, and desirable images are insured.

(23) The ink holding member of the drum consists of two or more different kinds of fibers each having a particular diameter. In this condition, thin fibers fill the gaps between thick fibers and thereby reduce the surface roughness of the ink holding member. This allows the ink to be drawn out from the ink holding member via the perforations of the film in an adequate amount during the course of printing. As a result, the infiltrating and drying time of the ink is reduced, so that rear smearing is reduced while desirable images are insured when use is made of the stencil implemented only by the film. In addition, the mixture of thick fibers and thin fibers enhances the durability of the drum without increasing the cost.

(24) The ink holding member of the drum has a plurality of ink holding layers in each of which bores sequentially decrease in size from the drum toward the stencil. Hence, the ink is easily fed and spread in the initial part of ink passageways. Further, the outer surface of outermost ink holding layer has a fiber diameter of greater than 1 μm inclusive, but smaller than 20 μm inclusive, preferably greater than 1 μm inclusive, but smaller than 15 μm inclusive or more preferably greater than 1 μm inclusive, but smaller than 8 μm inclusive. In this condition, bores existing in the ink holding member above the perforations of the film and filled with the ink are reduced in size, so that the amount of ink to be drawn out from the layer via the perforations is reduced. This successfully allows the ink to be drawn out from the ink holding member via the perforations of the film in an adequate amount and, thereby reduces the infiltrating and drying time of the ink. As a result, when use is made of the stencil implemented only by the film, papers are free from rear smearing, and desirable images are insured.

(25) The drum has a single ink holding member or layer configured such that its bores sequentially decrease in size from the drum side toward the stencil side. This kind of configuration obviates defective printing ascribable to a deviation particular to a plurality of ink holding layers. Also, the ink is easily fed and spread in the initial part of ink passageways. The outer surface of the single ink holding layer has a fiber diameter of greater than 1 μm inclusive, but smaller than 20 μm inclusive, preferably greater than 1 μm inclusive, but smaller than 15 μm inclusive or more preferably greater than 1 μm inclusive, but smaller than 8 μm inclusive. In this condition, bores existing in the ink holding layer above the perforations of the film and filled with the ink are reduced in size, so that the amount of ink to be drawn out from the layer via the perforations is reduced. This successfully allows the ink to be drawn out from the ink holding member via the perforations of the film in an adequate amount in the final part of the passageways and thereby reduces the infiltrating and drying time of the ink. As a result, when use is made of the stencil implemented only by the film, papers are free from rear smearing, and desirable images are insured.

(26) The ink holding member of the drum has at least its surface implemented by metal. This enhances the adhesion acting between such a high energy surface and the ink and thereby prevents the ink from being drawn out from the ink holding member in an excessive amount. Because the ink holding member is highly elastic, it discharges the ink when pressed by a pressing member and then sucks it when the pressing member is released from the member. Hence, the transfer of excess ink to a paper is obviated. This also eliminates rear smearing and insures desirable images when use is made of the stencil implemented only by the film. Moreover, because the ink holding member is strong, it does not yield even after a long time of operation and is free from corrosion due to the ink. The drum with such an ink holding member is durable and feasible for mass printing.

(27) Ink passageways are formed in the ink holding member such that the ink entered the member via an inlet pore is deflected at least once from a vertical extending to the outer periphery of the drum, and then caused to flow out via an outlet bore. This reduces the amount of ink to be drawn out from the ink holding member, reduces the infiltrating and drying time of the ink, and thereby reduces rear smearing.

(28) The ink holding member constituting the outer periphery of the drum has a fiber diameter of greater than 1 μm inclusive, but smaller than 20 μm inclusive, preferably greater than 1 μm inclusive, but smaller than 15 μm inclusive or more preferably greater than 1 μm inclusive, but smaller than 8 μm inclusive. In this condition, bores existing in the ink holding member on the outer periphery side of the drum and filled with the ink are reduced in size. This successfully allows the ink to be drawn out from the ink holding member in an adequate amount and thereby reduces the infiltrating and drying time of the ink. As a result, papers are free from rear smearing, and desirable images are insured.

(29) The ink holding member of the drum consists of two or more different kinds of fibers each having a particular diameter. In this condition, thin fibers fill the gaps between thick fibers and thereby reduce the surface roughness of the ink holding member. This allows the ink to be drawn out from the ink holding member in an adequate amount during the course of printing. As a result, the infiltrating and drying time of the ink is reduced, so that rear smearing is reduced while desirable images are insured. In addition, the mixture of thick fibers and thin fibers enhances the durability of the ink holding member without increasing the cost.

(30) The ink holding member constituting the outer periphery of the drum has bores thereinside which sequentially decrease in size toward the outer surface. Hence, the ink is easily fed and spread in the initial part of ink passageways, and then dawn out in an adequate amount in the final part of the same. This reduces the infiltrating and drying time of the ink and thereby obviates rear smearing while insuring desirable images.

(31) The ink holding member constituting the outer periphery of the drum has at least its surface implemented by metal. This enhances the adhesion acting between such a high energy surface and the ink and thereby prevents the ink from being drawn out from the ink holding member in an excessive amount. Because the ink holding member is highly elastic, it discharges the ink when pressed by a pressing member and then sucks it when the pressing member is released from the member. Hence, the transfer of excess ink to a paper is obviated. This also eliminates rear smearing and insures desirable images. Moreover, because the ink holding member is strong, it does not yield even after a long time of operation and is free from corrosion due to the ink. This kind of member is durable and feasible for mass printing.

(32) Ink passageways are formed in the ink holding member, which constitutes the outer periphery of the drum, such that the ink entered the member via an inlet pore is deflected at least once from a vertical extending to the surface of the member having an outlet pore, and then caused to flow out via the outlet pore. This reduces the amount of ink to be drawn out from the ink holding member, reduces the infiltrating and drying time of the ink, and thereby reduces rear smearing.

What is claimed is:

1. A drum for inking a thermoplastic resin film stencil, said drum supporting an ink holding member including a stencil wrapping and ink supplying outer surface, wherein said outer surface has a surface roughness of at least 5 $\mu$m Rz but less than 45 $\mu$m Rz.

2. The drum as claimed in claim 1, wherein said ink holding member comprises at least two different kinds of fibers each having a particular diameter.

3. The drum as claimed in claim 1, wherein said ink holding member has bores therein which sequentially decrease in size along a direction from an inner surface of said ink holding member toward said outer surface.

4. The drum as claimed in claim 1, wherein said ink holding member has at least a surface thereof formed by metal.

5. The drum as claimed in claim 1, wherein said ink holding member further comprises an inner surface having inlet pores for receiving ink, outlet pores in said outer surface for outputting the ink, and passageways between the inlet pores and the outlet pores for causing the ink received at any one of said inlet pores to be deflected at least once from a direction of flow along a vertical axis extending to said outer surface to then be provided to an associated one of said outlet pores.

6. A stencil inking apparatus comprising a drum supporting an ink holding member on an outer periphery thereof for providing ink to a stencil wrapped on said ink holding member, said stencil including a thermoplastic resin film formed on a porous substrate, wherein the ink holding member and the porous substrate are in contact and provide a thickness which is at least 5 $\mu$m, but smaller than 45 $\mu$m, and which is measured as a sum of a surface roughness thickness of said ink holding member, as measured on a side thereof contacting said porous substrate, and a thickness of said porous substrate.

7. The apparatus as claimed in claim 6, wherein said ink holding member comprises at least two different kinds of fibers each having a particular diameter.

8. The apparatus as claimed in claim 6, wherein said ink holding member has bores therein which sequentially decrease in size along a direction from an inner surface of said ink holding member toward an outer surface thereof.

9. The apparatus as claimed in claim 6, wherein said ink holding member has at least a surface thereof formed by metal.

10. The apparatus as claimed in claim 6, wherein said ink holding member further comprises an inner surface having inlet pores for receiving ink, an outer surface having outlet pores for outputting the ink, and passageways between the inlet pores and the outlet pores for causing the ink received at any one of said inlet pores to be deflected at least once from a direction of flow along a vertical axis extending to said outer surface to then be provided to an associated one of said outlet pores.

11. A stencil inking drum having an outer surface configured to wrap and supply ink to a stencil, said outer surface having a surface roughness of at least 5 $\mu$m Rz, but less than 45 $\mu$m Rz.

12. The drum as claimed in claim 11, wherein said outer surface includes at least two different kinds of fibers each having a particular diameter.

13. The drum as claimed in claim 11, wherein said outer surface includes bores therein which sequentially decrease in size along a direction from inside the drum toward said outer surface.

14. The drum as claimed in claim 11, wherein said drum has at least a surface thereof formed by metal.

15. The drum as claimed in claim 11, wherein said drum includes an inner surface having inlet pores for receiving ink, outlet pores in said outer surface for outputting the ink, and passageways between the inlet pores and the outlet pores for causing the ink received at any one of said inlet pores to be deflected at least once from a direction of flow along a vertical axis extending to said outer surface to then be provided to an associated one of said outlet pores.

16. A drum for inking a stencil comprising an ink holding plurality of fibers forming an outer surface for wrapping and supplying ink to the stencil, wherein said fibers have a fiber diameter of at least 1 $\mu$m, but smaller than 20 $\mu$m, as measured at said outer drum surface.

17. The drum as claimed in claim 16, wherein said fibers includes at least two different kinds of fibers each having a particular diameter.

18. The drum as claimed in claim 16, wherein said fibers have at least a surface thereof formed by metal.

19. The drum as claimed in claim 16, wherein said fibers are arranged to have a thickness to provide an inner surface with inlet pores for receiving ink, outlet pores in said outer surface for outputting the ink, and passageways between the inlet pores and the outlet pores for causing the ink received at any one of said inlet pores to be deflected at least once from a direction of flow along a vertical axis extending to said outer surface to then be provided to an associated one of said outlet pores.

20. A drum for inking a stencil comprising a plurality of ink holding members laminated in layers on said drum exterior and forming an outer surface on an outermost layer for wrapping and supplying ink to a thermoplastic resin film stencil, wherein said layers have interior bores which sequentially decrease in size from an innermost one of said layers to said outermost one of said layers, wherein at least said outermost one of said layers is made up of fibers that have a fiber diameter of at least 1 $\mu$m, but smaller than 20 $\mu$m, as measured at said outer surface.

21. The drum as claimed in claim 20, wherein at least one of said layers has at least a surface thereof formed by metal.

22. The drum as claimed in claim 20, wherein at least said outermost layer further comprises an inner surface having inlet pores for receiving ink, outlet pores in said outer surface for outputting the ink, and passageways between the inlet pores and the outlet pores for causing the ink received at any one of said inlet pores to be deflected at least once from a direction of flow along a vertical axis extending to said outer surface to then be provided to an associated one of said outlet pores.

23. A drum for inking a stencil, said drum supporting a single ink holding member formed as a layer of fibers, said layer having an outer layer surface configured for wrapping and supplying ink to a thermoplastic resin film stencil, said layer having interior bores which sequentially decrease in size along a direction from an inside layer surface toward said outer layer surface, wherein said fibers have a fiber diameter of at least 1 $\mu$m, but smaller than 20 $\mu$m, as measured at said outer surface.

24. The drum as claimed in claim 23, wherein said layer has at least a surface thereof formed by metal.

25. The drum as claimed in claim 23, wherein said layer comprises inlet pores in said inside layer surface for receiving ink, outlet pores in said outer layer surface for outputting the ink, and passageways between the inlet pores and the outlet pores for causing the ink received at any one of said inlet pores to be deflected at least once from a direction of flow along a vertical axis extending to said outer layer surface to then be provided to an associated one of said outlet pores.

26. A drum for inking a stencil, said drum supporting an ink holding member forming a stencil wrapping and ink supplying outer surface including fibers having a fiber diameter of at least 1 $\mu$m, but smaller than 20 $\mu$m, as measured at said outer surface.

27. The drum as claimed in claim 26, wherein said ink holding member comprises at least two different kinds of fibers each having a particular diameter.

28. The drum as claimed in claim 26, wherein said ink holding member has bores therein which sequentially decrease in size in a direction from an inner surface of said ink holding member toward said outer surface.

29. The drum as claimed in claim 26, wherein said ink holding member has at least a surface thereof formed by metal.

30. The drum as claimed in claim 26, wherein said ink holding member further comprises an inner surface having inlet pores for receiving ink, outlet pores in said outer surface for outputting the ink, and passageways between the inlet pores and the outlet pores for causing the ink received at any one of said inlet pores to be deflected at least once from a direction of flow along a vertical axis extending to said outer surface to then be provided to an associated one of said outlet pores.

* * * * *

UNITED STATES PATENT AND TRADEMARK OFFICE

CERTIFICATE OF CORRECTION

PATENT NO. : 5,855,169

DATED : January 5, 1999

INVENTOR(S): TOMIYA MORI, ET AL.

It is certified that an error appears in the above-identified patent and that said Letters Patent is hereby corrected as shown below:

Column 1, in the title, please change the word "PRINTING" to --PRINTER--.
Column 6, line 31, please take out "-" (hypen) before the word "to";
line 34, change "damper 7" to --clamper 7--;
line 36, change "damper 7" to --clamper 7--;
line 40, change "damper 7" to --clamper 7--.
Column 12, line 1, change "such a sintered" to --such as a sintered--.
Column 13, line 23, change "stencil 43" to --stencil 27--.
Column 18, line 13, change "entered" to --entering--.
Column 19, line 22, change "seven" to --seventh--.
Column 21, line 3, change "such a" to --such as--.
Column 23, line 25, change "entered" to --entering--.
Column 24, line 12, change "entered" to --entering ;
line 65, change "entered" to --entering--.
Column 25, line 49, remove "," after the word "and".
Column 26, line 24, change "entered" to --entering--;
line 58, change "dawn" to --drawn--.
Column 27, line 12, change "entered" to --entering--.
Column 34 , change "includes" to --include--.

Signed and Sealed this

Twentieth Day of February, 2001

*Attest:*

Nicholas P. Godici

NICHOLAS P. GODICI

*Attesting Officer*

*Acting Director of the United States Patent and Trademark Office*